US009840080B1

(12) United States Patent
Kobayashi et al.

(10) Patent No.: US 9,840,080 B1
(45) Date of Patent: Dec. 12, 2017

(54) LIQUID EJECTING APPARATUS

(71) Applicant: SEIKO EPSON CORPORATION, Tokyo (JP)

(72) Inventors: Takumi Kobayashi, Nagano (JP); Shoma Kudo, Nagano (JP); Naomi Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/176,615

(22) Filed: Jun. 8, 2016

(51) Int. Cl.
*B41J 2/175* (2006.01)

(52) U.S. Cl.
CPC ..... *B41J 2/17503* (2013.01); *B41J 2/175* (2013.01)

(58) Field of Classification Search
CPC ..... B41J 2/17503; B41J 2/175
See application file for complete search history.

(56) References Cited

U.S. PATENT DOCUMENTS 4,358,781 A * 11/1982 Yamamori ..... B41J 2/14298 347/21
8,454,139 B2 6/2013 Ishizawa et al.
2012/0062648 A1* 3/2012 Tanaka ..... B41J 19/00 347/37
2015/0284170 A1 10/2015 Igarashi et al.
2015/0367648 A1* 12/2015 Kimura ..... B41J 2/17509 347/86

FOREIGN PATENT DOCUMENTS

JP 2012-020497 A 2/2012
JP 2003-145789 A 5/2013
JP 2015-139919 A 8/2015
JP 2015-199261 A 11/2015

* cited by examiner

*Primary Examiner* — Manish S Shah
*Assistant Examiner* — Yaovi M Ameh
(74) *Attorney, Agent, or Firm* — Global IP Counselors, LLP

(57) ABSTRACT

A tank for containing liquid to be supplied to a liquid ejecting apparatus which has a nozzle formation section where nozzles are formed, which performs printing onto a printing medium by ejecting the liquid from the nozzles toward the printing medium, and where a front end of the nozzle formation section and a rear end of the nozzle formation section are positioned along a discharge direction of the printing medium when a discharge opening of the liquid ejecting apparatus, which discharges the printing medium, is the front side, wherein the tank is disposed so that the liquid surface of the liquid which is contained in the tank is lower than the rear end of the nozzle formation section in a first posture where the nozzles face in the horizontal direction and the front end of the nozzle formation section is positioned above the rear end.

1 Claim, 17 Drawing Sheets

LIQUID EJECTING APPARATUS

TECHNICAL FIELD

The present invention relates to a liquid container and the like.

PRIOR ART

Ink jet printers are known in the prior art as one example of a liquid ejecting apparatus. It is possible for an ink jet printer to perform printing onto a printing medium, such as a paper sheet for printing, by discharging ink, which is one example of a liquid, from an ejecting head onto the printing medium. Among these liquid ejecting apparatuses, liquid ejecting apparatuses are known which have a liquid supplying apparatus where ink, which is retained in a tank which is one example of a liquid container, is supplied to an ejecting head (a printing head) via a tube (hose) (for example, refer to PTL 1). Here, there are times when the configuration where the liquid supplying apparatus is added to the liquid ejecting apparatus is referred to below as a liquid ejecting system.

CITATION LIST

Patent Literature

PTL 1: Japanese Unexamined Patent Application Publication No. 2012-20497

SUMMARY OF THE INVENTION

Problems to be Solved by the Invention

A technique is disclosed in PTL 1 described above where, in a tank which has a liquid container where it is possible for liquid to be contained and an air opening flow path where it is possible for air to be introduced into the liquid container, it is possible to reduce the possibility that liquid flows out from an air opening flow path to the outside even when the posturing of the tank changes. However, a technique, where it is difficult for liquid to flow out from the ejecting head in a state where the liquid ejecting apparatus which is connected to the tank tips over, is not disclosed in PTL 1 described above.

Means to Solve the Problems

The present invention is carried out in order to resolve at least a portion of the problems described above and can be realized as the following aspects and applied examples.

Applied Example 1

A liquid container where liquid is contained in order to be supplied with regard to a liquid ejecting apparatus which has a nozzle formation section where nozzles are formed, which performs printing onto a printing medium using liquid by ejecting the liquid from the nozzles toward the printing medium, and where a front end of the nozzle formation section and a rear end of the nozzle formation section are positioned along a discharge direction of the printing medium when a discharge opening of the liquid ejecting apparatus, which discharges the printing medium onto' which printing is performed via the discharge opening, is the front side, wherein the liquid container is disposed so that the liquid surface of the liquid which is contained in the liquid container is lower than the rear end of the nozzle formation section in a first posture where the nozzles face in the horizontal direction and the front end of the nozzle formation section is positioned above the rear end.

According to the liquid container in this applied example, it is easy to suppress the liquid in the vicinity of the nozzles from being pressurized by the liquid which is contained in the liquid container since the liquid surface of the liquid which is contained in the liquid container is lower than the nozzle formation section even when the posture of the liquid ejecting apparatus is changed to the first posture. Due to this, it is possible to reduce the possibility that liquid flows out from the nozzles even when the flow path for liquid between the liquid container and the nozzle is not closed off in the first posture.

Applied Example 2

A liquid container which is the liquid container described above which has a liquid supply opening for supplying the liquid which is contained in the liquid container to the liquid ejecting apparatus and which is disposed so that the liquid surface is higher than the rear end of the nozzle formation section and the liquid supply opening is higher than the liquid surface in a second posture where the nozzles face in the horizontal direction and the front end of the nozzle formation section is positioned below the rear end.

In this applied example, it is easy for pressure due to the head of water of the liquid which is contained in the liquid container to block the liquid supply opening since the liquid supply opening is higher than the liquid surface of the liquid which is contained in the liquid container even when the liquid surface of the liquid which is contained in the liquid container is higher than the nozzle formation section due to the posture of the liquid ejecting apparatus changing to the second posture. Due to this, it is possible to reduce the possibility that liquid flows out from the nozzles even when the flow path for liquid between the liquid container and the nozzle is not closed off in the second posture.

Applied Example 3

A liquid container where it is possible for liquid to be contained in order to be supplied with regard to a liquid ejecting apparatus which has a nozzle formation section where nozzles are formed, which performs printing onto a printing medium using liquid by ejecting the liquid from the nozzles toward the printing medium, and where a front end of the nozzle formation section and a rear end of the nozzle formation section are positioned along a discharge direction of the printing medium when a discharge opening of the liquid ejecting apparatus, which discharges the printing medium onto which printing is performed via the discharge opening, is the front side, wherein the liquid container includes a first liquid containing section and a second liquid containing section, the first liquid containing section and the second liquid containing section each have a liquid supply opening for supplying the liquid which is contained in an inner section to the liquid ejecting apparatus, the first liquid containing section is disposed so that the liquid surface of the liquid which is contained in the first liquid containing section is lower than the rear end of the nozzle formation section in a first posture where the nozzles face in the horizontal direction and the front end of the nozzle formation section is positioned above the rear end and the second liquid containing section is disposed so that the liquid surface of the liquid which is contained in the second liquid containing section is higher than the rear end of the nozzle formation section and the liquid supply opening is higher than the liquid surface in the first posture, and the second liquid containing section is disposed so that the liquid surface of the liquid which is contained in the second liquid containing section is lower than the rear end of the nozzle formation section in a second posture where the nozzles face in the horizontal direction and the front end of the nozzle formation section is positioned below the rear end and the first liquid containing section is disposed so that the liquid surface of the liquid which is contained in the first liquid containing section is higher than the rear end of the nozzle formation section and the liquid supply opening is higher than the liquid surface in the second posture.

According to the liquid container in this applied example, it is easy to suppress the liquid in the vicinity of the nozzles from being pressurized by the liquid which is contained in the first liquid containing section since the liquid surface of the liquid which is contained in the first liquid containing section is lower than the nozzle formation section even when the posture of the liquid ejecting apparatus is changed to the first posture. In addition, it is easy for pressure due to the head of water of the liquid which is contained in the second liquid containing section to block the liquid supply opening since the liquid supply opening is higher than the liquid surface of the liquid which is contained in the second liquid containing section even when the liquid surface of the liquid which is contained in the second liquid containing section is higher than the nozzle formation section in the first posture. Due to this, it is possible to reduce the possibility that liquid flows out from the nozzles even when the flow path for liquid between the liquid container and the nozzle is not closed off in the first posture. In addition, it is easy to suppress the liquid in the vicinity of the nozzles from being pressurized by the liquid which is contained in the second liquid containing section since the liquid surface of the liquid which is contained in the second liquid containing section is lower than the nozzle formation section even when the posture of the liquid ejecting apparatus is changed to the second posture. In addition, it is easy for pressure due to the head of water of the liquid which is contained in the first liquid containing section to block the liquid supply opening since the liquid supply opening is higher than the liquid surface of the liquid which is contained in the first liquid containing section even when the liquid surface of the liquid which is contained in the first liquid containing section is higher than the nozzle formation section in the second posture. Due to this, it is possible to reduce the possibility that liquid flows out from the nozzles even when the flow path for liquid between the liquid container and the nozzle is not closed off in the second posture.

Applied Example 4

A liquid container which is the liquid container described above where the first liquid containing section and the second liquid containing section are disposed so that a region between the front end and the rear end of the nozzle formation section is symmetrical in a front and rear direction, which is a direction which links the front end and the rear end, with regard to a hypothetical region which extends in a direction which intersects with the front and rear direction.

In this applied example, it is possible for the first liquid containing section and the second liquid containing section to be disposed to line up in the front and rear direction.

DESCRIPTION OF THE EMBODIMENTS

An embodiment of the present invention will be described with reference to the diagrams with an example of a liquid ejecting system which includes an ink jet printer (which is referred to below as a printer) which is one example of a liquid ejecting apparatus. Here, there are times when the scale of the configuration and members differs in each of the diagrams in order for each of the configurations to be a size to such an extent where recognition is possible.

Figure 1:
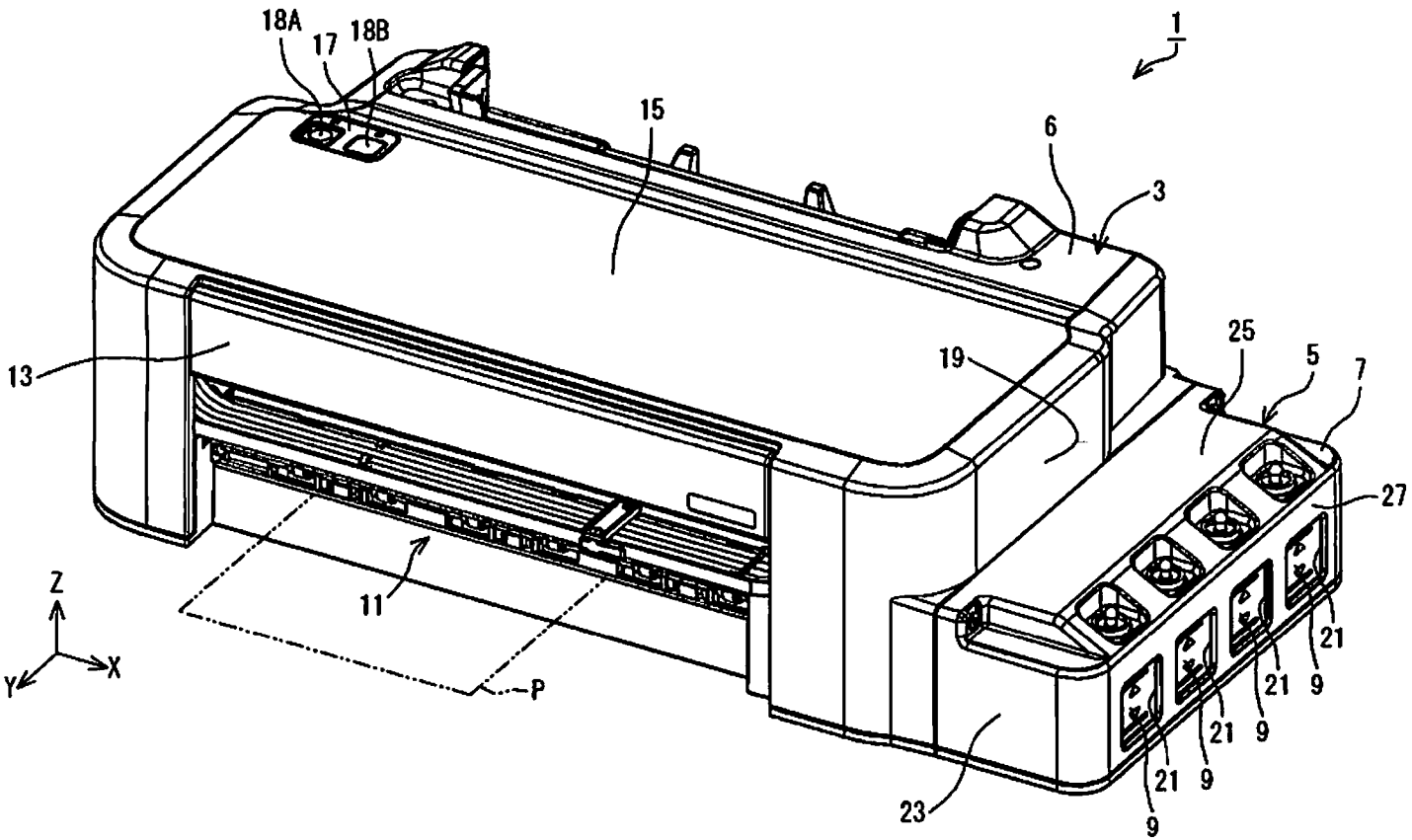
FIG. 1 is a perspective diagram illustrating a liquid ejecting system in an embodiment of the present invention.

A liquid ejecting system 1 in the embodiment of the present invention has a printer 3 which is one example of a liquid ejecting apparatus and a tank unit 5 as shown in FIG. 1. The printer 3 has a first case 6. The first case 6 configures the outer shell of the printer 3. The tank unit 5 has a second case 7 and a plurality of (two or more) tanks 9. The first case 6 and the second case 7 configure the outer shell of the liquid ejecting system 1. The tank 9 is one example of a liquid container. It is possible for the liquid ejecting system 1 to perform printing onto a printing medium P such as a paper sheet for printing using ink which is one example of a liquid.

Here, XYZ axes which are coordinate axes orthogonal to each other are applied in FIG. 1. The XYZ axes are applied according to requirements in other diagrams in which the axes are shown. For each of the XYZ axes, the direction of the arrows indicates a + direction (plus direction) and the opposite to the direction of the arrows indicates a – direction (minus direction). In a state where the liquid ejecting system 1 is being used, the liquid ejecting system 1 is placed on a horizontal flat surface which is regulated in the X axis and Y axis. In a state where the liquid ejecting system 1 is being used, the Z axis is the axis which is orthogonal to the horizontal flat surface and the –Z axis direction is vertically downward.

A constituent unit 10 (FIG. 4) of the printer 3 is contained in the first case 6. The constituent unit 10 is constituent parts which execute printing actions in the printer 3. The details on the constituent unit 10 will be described later. The plurality of tanks 9 are contained inside the second case 7 as shown in FIG. 1 and each contain ink which is for printing. In the present embodiment, four of the tanks 9 are provided. Among the four of the tanks 9, the types of ink are different for each of the tanks 9. Four types of black, yellow, magenta, and cyan are adopted as the types of ink in the present embodiment. Then, one of each of the tank 9 which contains black ink, the tank 9 which contains yellow ink, the tank 9 which contains magenta ink, and the tank 9 which contains cyan ink are provided. The plurality of tanks 9 are provided on the outer side of the first case 6 in the liquid ejecting system 1. For this reason, the plurality of tanks 9 are not built into the first case 6 which covers the constituent unit 10 in the liquid ejecting system 1.

In addition, a sheet discharge section 11 which is one example of a discharge opening is provided in the printer 3. In the printer 3, the printing medium P is discharged from the sheet discharge section 11. In the printer 3, the surface where the sheet discharge section 11 is provided is set as a front surface 13. In addition, the printer 3 has an operation panel 17 on an upper surface 15 which intersects with the front surface 13. A power source button 18A, other operation buttons 18B, and the like are provided in the operation panel 17. The tank unit 5 is provided in the first case 6 at a side section 19 which intersects with the front surface 13 and the upper surface 15. A window section 21 is provided in the second case 7. The window section 21 is provided in the second case 7 at a side section 27 which intersects with a front surface 23 and an upper surface 25. The window section 21 has optical transparency. Then, the four tanks 9 described above are provided at a position which overlaps with the window section 21. For this reason, it is possible for an operator who is using the liquid ejecting system 1 to visually confirm the four tanks 9 via the window section 21.

Figure 2:
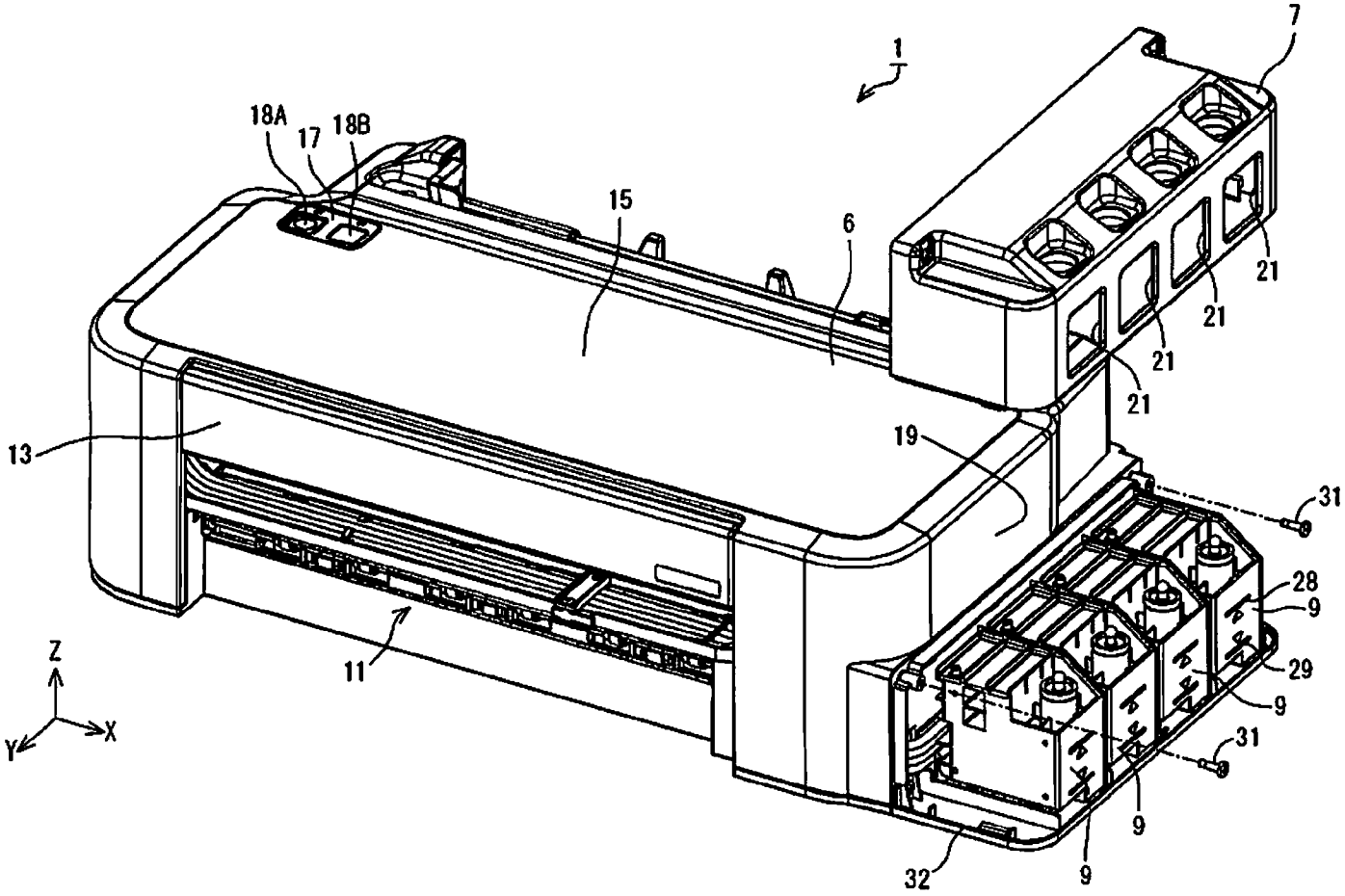
FIG. 2 is a perspective diagram illustrating a liquid ejecting system in an embodiment of the present invention.

At least a portion of parts in each of the tanks 9 which oppose the window section 21 have optical transparency in the present embodiment. It is possible to visually confirm the ink inside the tanks 9 from parts in each of the tanks 9 which have optical transparency. Accordingly, it is possible for an operator to visually confirm the amount of ink in each of the tanks 9 by visually confirming the four tanks 9 via the window section 21. That is, it is possible for at least a portion of part in the tanks 9 which opposes the window section 21 to be utilized as a visually confirming section where it is possible to visually confirm the amount of ink. The first case 6 and the second case 7 are configured from bodies which are separate from each other. For this reason, it is possible for the second case 7 to be separated from the first case 6 in the present embodiment as shown in FIG. 2. The second case 7 is joined with the first case 6 using an attachment pin 31. In addition, the second case 7 covers at least a portion of the tanks 9 such as, for example, the front surface, the upper surface, and the side surfaces as shown in FIG. 2. Here, an upper limit mark 28 which indicates the upper limit for the amount of ink and a lower limit mark 29 which indicates the lower limit for the amount of ink are provided in each of the tanks 9 at parts which oppose the window section 21. It is possible for an operator to ascertain the amount of ink in each of the tanks 9 with the upper limit mark 28 and the lower limit mark 29 as indicators.

Figure 3:
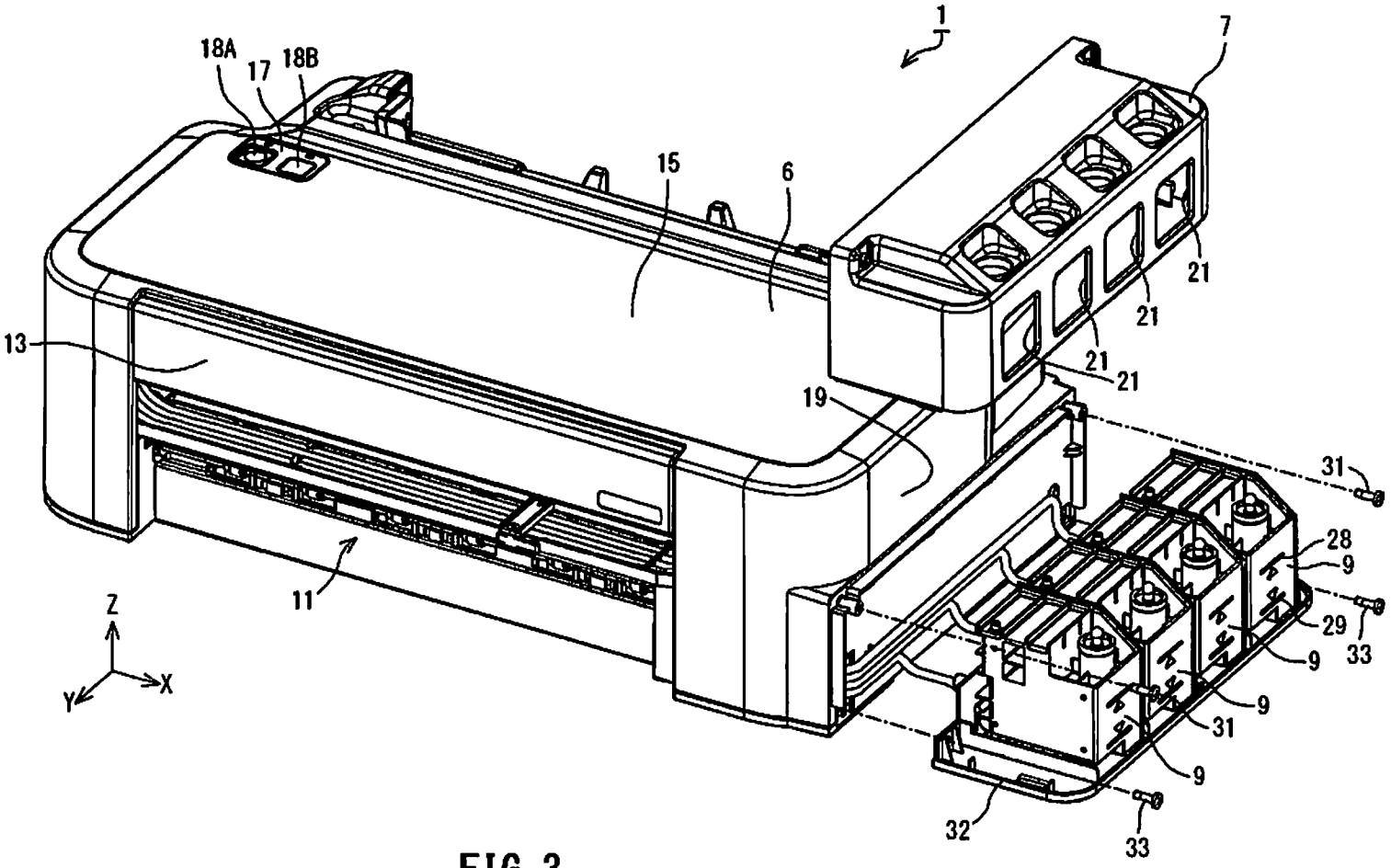
FIG. 3 is a perspective diagram illustrating a liquid ejecting system in an embodiment of the present invention.

In addition, the tank unit 5 has a support frame 32. The four tanks 9 are supported by the support frame 32. The support frame 32 is configured using a separate body to the first case 6. For this reason, it is possible for the support frame 32 to be separated from the first case 6 in the present embodiment as shown in FIG. 3. The support frame 32 is joined with the first case 6 using an attachment pin 33. In this manner, the tank unit 5 (FIG. 1) is attached to the outer side of the first case 6 in the present embodiment.

Figure 4:
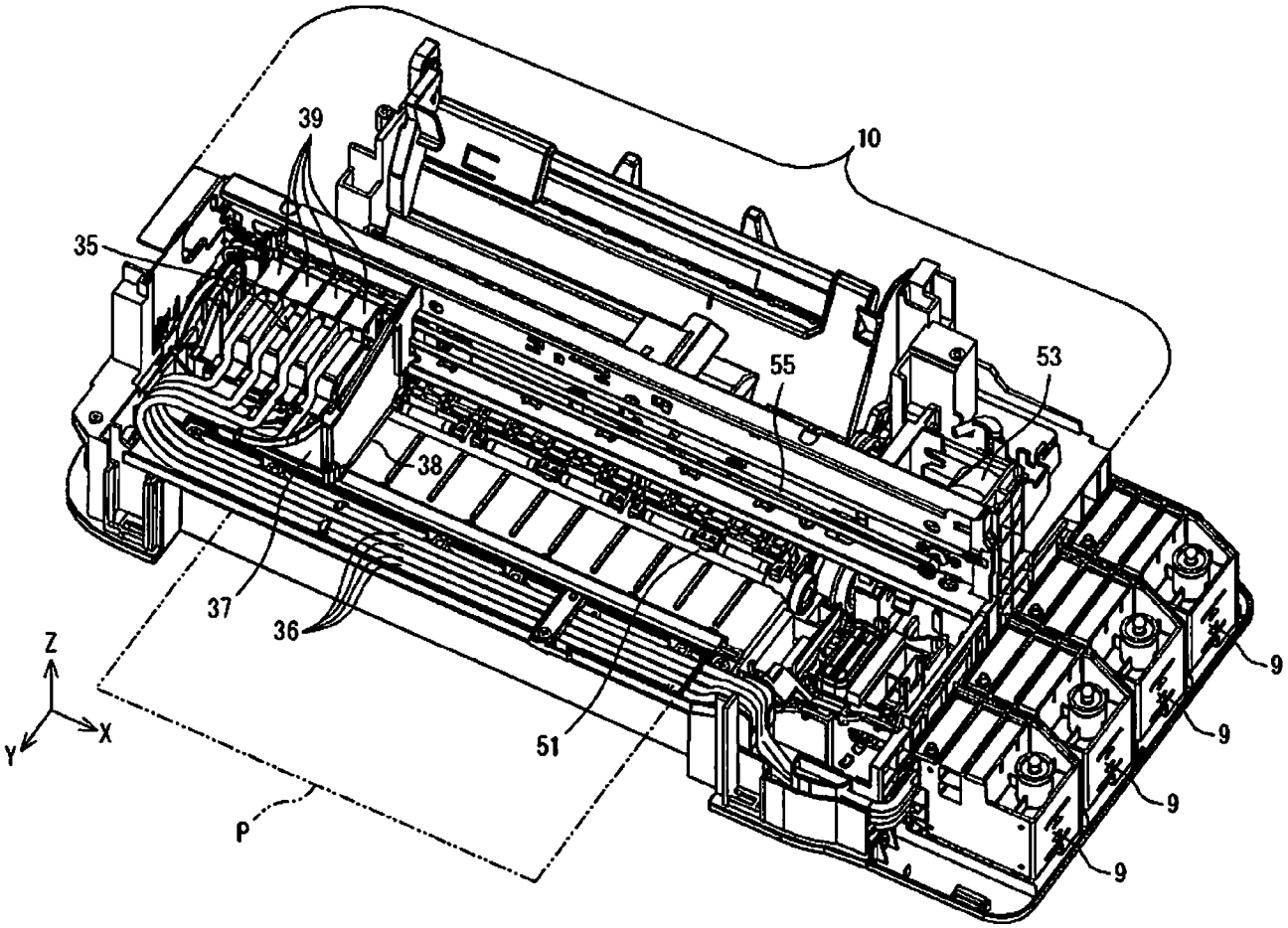
FIG. 4 is a perspective diagram illustrating a constituent unit for a printer in an embodiment of the present invention.

The printer 3 has a printing section 35 and supply tubes 36 as shown in FIG. 4 which is a perspective diagram illustrating the constituent unit 10. The printing section 35 has a carriage 37, a printing head 38, and four relay units 39. The printing head 38 and the four relay units 39 are mounted on the carriage 37. The supply tubes 36 have flexibility and are provided between the tanks 9 and the relay units 39. The ink inside the tanks 9 is sent to the relay units 39 via the supply tubes 36. The relay units 39 relay the ink, which is supplied from the tanks 9 via the supply tubes 36, to the printing head 38. The printing head 38 discharges the ink which is supplied as ink droplets.

Figure 5:
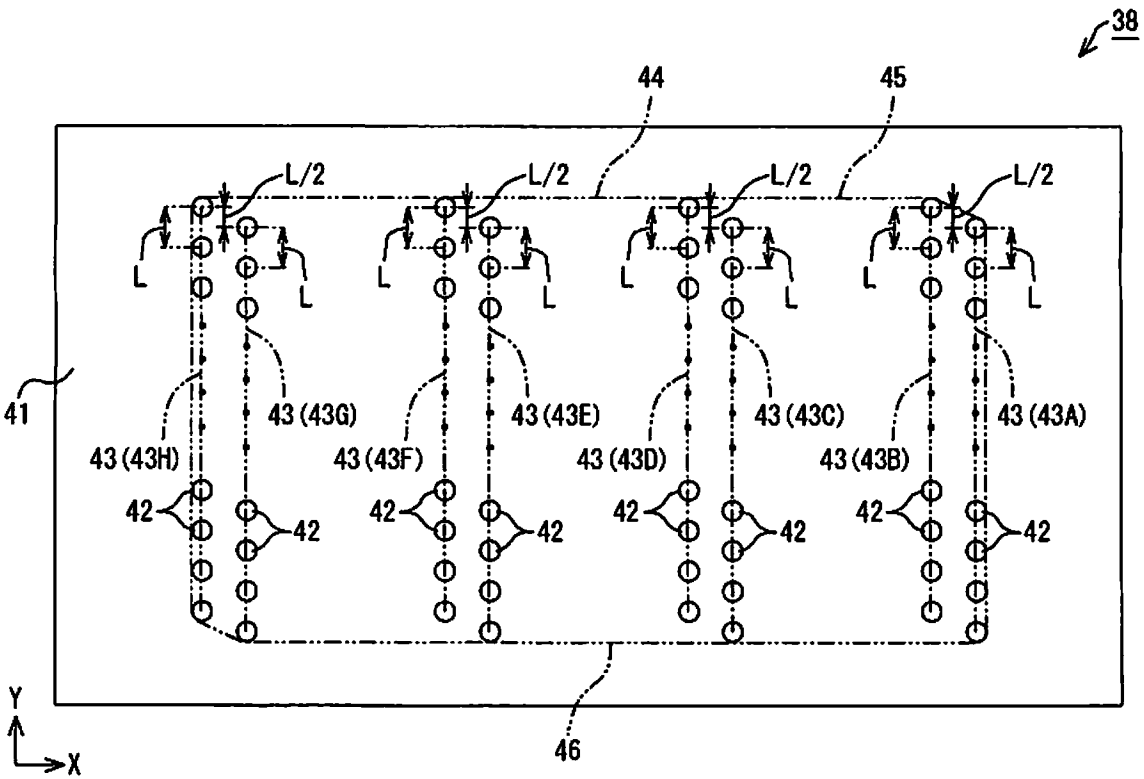
FIG. 5 is a bottom surface diagram illustrating a printing head in an embodiment of the present invention.

Here, details on the printing head 38 will be described. The printing head 38 has a nozzle surface 41 as shown in FIG. 5 which is a bottom surface diagram. A plurality of nozzles 42 which discharge ink droplets are formed in the nozzle surface 41. Here, the nozzles 42 are exaggerated and the number of the nozzles 42 is reduced in FIG. 5 so that it is easy for the nozzles 42 to be clearly seen. The plurality of nozzles 42 in the printing head 38 are configured from eight nozzle rows 43 which are aligned along the X axis. The eight nozzle rows 43 line up in a state so as to be spaced from each other along the Y axis. The plurality of nozzles 42 in each of the nozzle rows 43 are formed with a predetermined nozzle spacing L along the X axis. Below, in cases where each of the eight nozzle rows 43 are to be separately identified, the eight nozzle rows 43 are each labelled as a nozzle row 43A, a nozzle row 43B, a nozzle row 43C, a nozzle row 43D, a nozzle row 43E, a nozzle row 43F, a nozzle row 43G, and a nozzle row 43H.

In the printing head 38, the nozzle row 43A and the nozzle row 43B are shifted away from each other by a distance of L/2 along the X axis. The nozzle row 43C and the nozzle row 43D are also shifted away from each other by a distance of L/2 along the X axis. In the same manner, the nozzle row 43E and the nozzle row 43F are also shifted away from each other by a distance of L/2 along the X axis, and the nozzle row 43G and the nozzle row 43H are also shifted away from each other by a distance of L/2 along the X axis. The eight nozzle rows 43 in the printing head 38 are segmented for each type of ink. In the present embodiment, the nozzles 42 which belong to the nozzle row 43A and the nozzle row 43B discharge black (K) ink as ink droplets. The nozzles 42 which belong to the nozzle row 43C and the nozzle row 43D discharge cyan (C) ink as ink droplets. The nozzles 42 which belong to the nozzle row 43E and the nozzle row 43F discharge magenta (M) ink as ink droplets. The nozzles 42 which belong to the nozzle row 43G and the nozzle row 43H discharge yellow (Y) ink as ink droplets.

The plurality of nozzles 42 in the nozzle surface 41 form a nozzle formation section 44. The nozzle formation section 44 is a region which includes all of the nozzles 42, which perform discharging of ink droplets, out of the plurality of nozzles 42. In addition, the nozzle formation section 44 is a region which is surrounded by the outer edges of the plurality of nozzles 42, which are positioned on the far outer edges among the nozzles 42 which are included in the nozzle formation section 44, being joined together over the shortest possible distance. The nozzle formation section 44 is regulated by the plurality of nozzles 42 which are positioned on the far outer edges among the nozzles 42 which are included in the nozzle formation section 44. The nozzles 42 which do not communicate with the supply tubes 36 are not included among the plurality of nozzles 42 which regulate the nozzle formation section 44. In the present embodiment, in the liquid ejecting system 1 which is shown in FIG. 1, the front surface 13 side where the sheet discharge section 11 is provided is defined as the front side and the opposite side to the front surface 13 side is defined as the rear side. Then, in the present embodiment, in the bottom surface diagram of the nozzle surface 41 (FIG. 5), the part which is positioned farthest to the Y axis direction out of the nozzle formation section 44, that is, the part which is positioned on the front side of the liquid ejecting system 1 is defined as a front end 45 of the nozzle formation section 44. In addition, the part which is positioned farthest to the −Y axis direction out of the nozzle formation section 44 is defined as a rear end 46 of the nozzle formation section 44.

In addition, the printer 3 which is shown has a medium transport mechanism (which is not shown in the diagram) and a head transport mechanism (which is not shown in the diagram) as shown in FIG. 4. The medium transport mechanism transports the printing medium P along the Y axis direction by a transport roller 51 (FIG. 4) being driven due to motive force from a motor which is not shown in the diagram. The head transport mechanism transports the carriage 37 along the X axis direction by motive force from a motor 53 being transferred to the carriage 37 via a timing belt 55. The printing head 38 is mounted on the carriage 37. For this reason, it is possible for the printing head 38 to be transported in the X axis direction via the carriage 37 using the head transport mechanism. Here, the printing head 38 is supported by the carriage 37 in a state of facing the printing medium P. Printing is carried out on the printing medium P by ink being discharged from the printing head 38 while the relative position of the printing head 38 with regard to the printing medium P is changed using the medium transport mechanism and the head transport mechanism.

Figure 6:
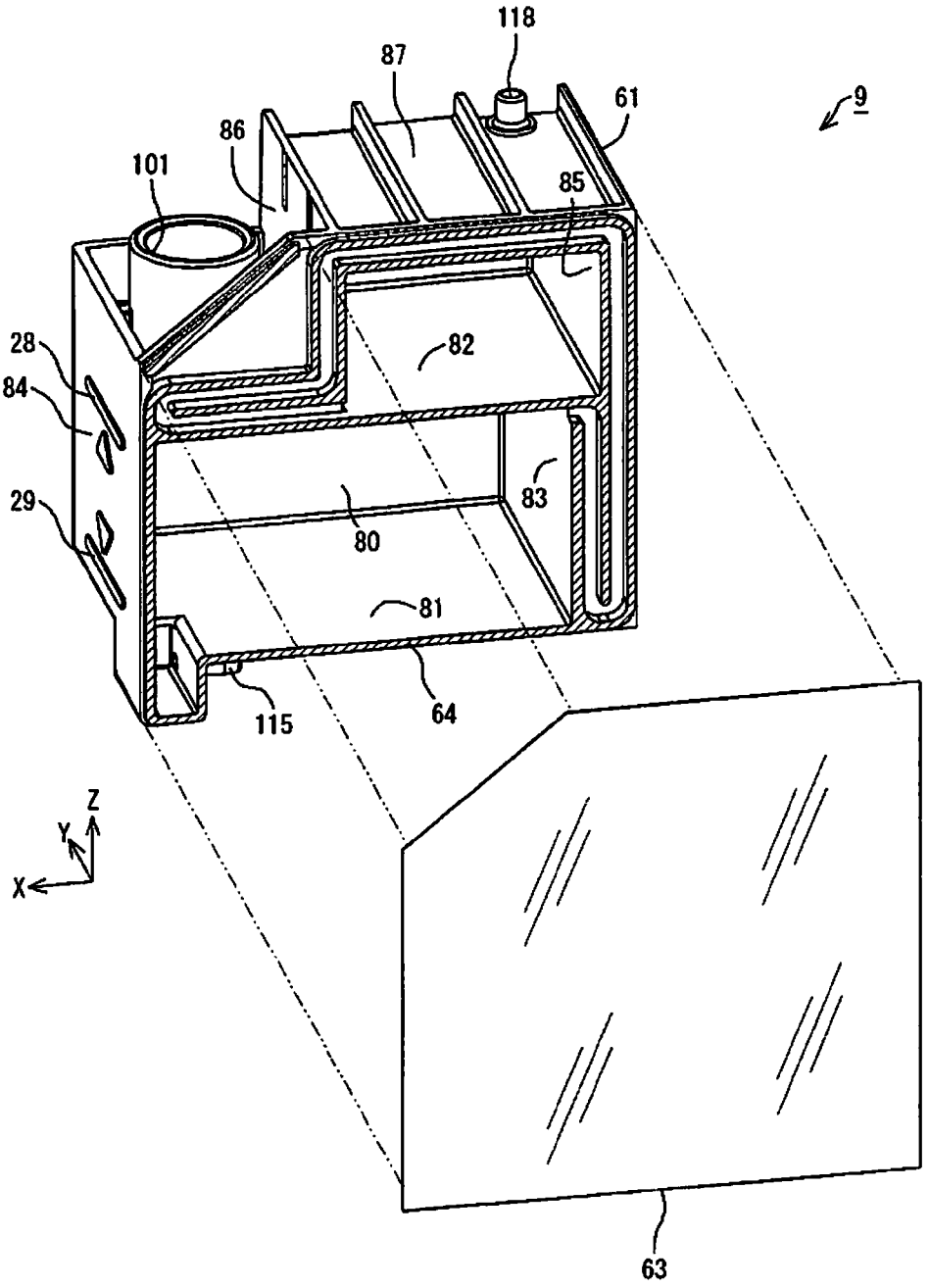
FIG. 6 is a perspective diagram illustrating a breakdown of a tank in an embodiment of the present invention.

The tank 9 will be described. The tank 9 has a case 61 which is one example of a tank main body and a sheet member 63 as shown in FIG. 6. The case 61 is configured using, for example, a synthetic resin such as nylon or polypropylene. In addition, the sheet member 63 is formed in a film form using a synthetic resin (for example, nylon, polypropylene, or the like) and has flexibility. In the present embodiment, the sheet member 63 has optical transparency. The tank 9 has a configuration where the case 61 and the sheet member 63 are bonded together. A bonding section 64 is provided in the case 61. Shading is carried out for the bonding section 64 in FIG. 6 so that the configuration is easy to understand. The sheet member 63 is bonded together with the bonding section 64 of the case 61. In the present embodiment, the case 61 and the sheet member 63 are bonded together through adhesion.

Figure 7:
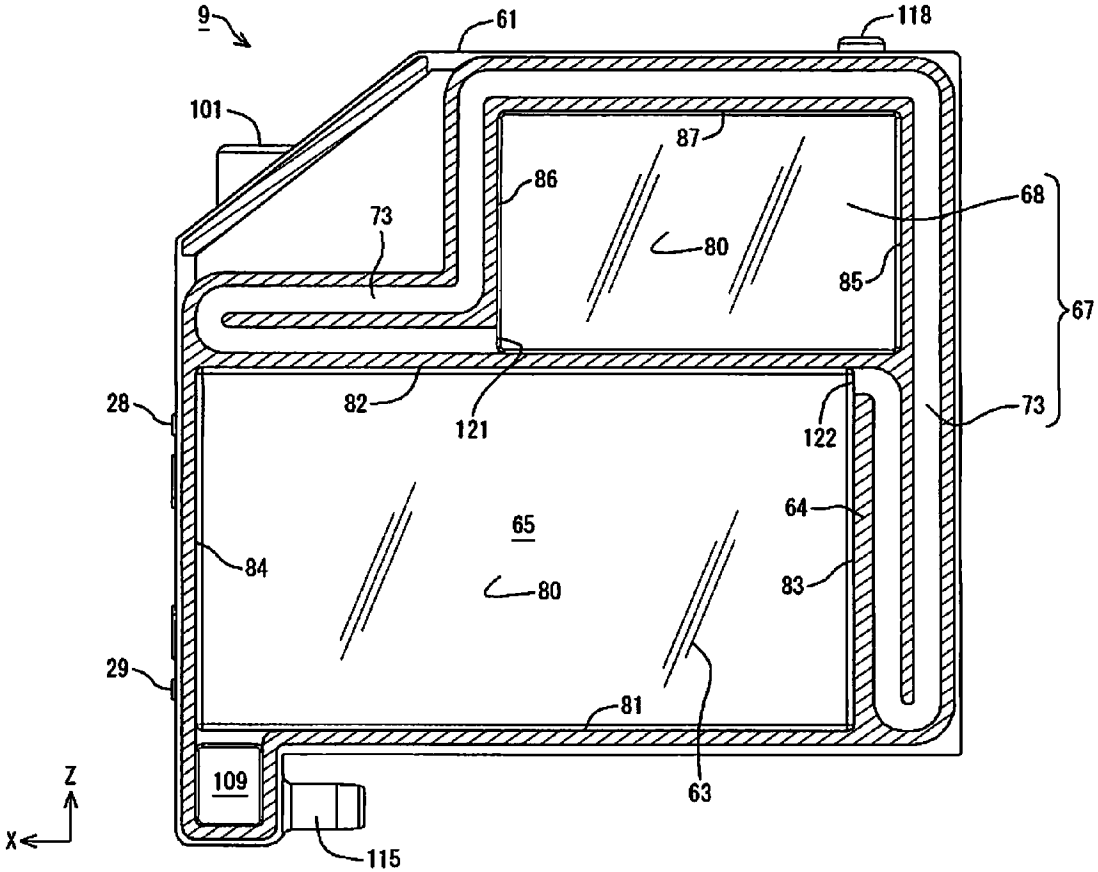
FIG. 7 is a side surface diagram when a tank in an embodiment of the present invention is viewed from a sheet member side.

The tank 9 has a containing section 65 and a communication section 67 as shown in FIG. 7. The communication section 67 has an air chamber 68 and a communication path 73. Ink is contained in the tank 9 inside the containing section 65. Here, the state where the tank 9 is viewed from the sheet member 63 side is shown in FIG. 7 and the case 61 which is beyond the sheet member 63 is shown in the diagram. The containing section 65, the air chamber 68, and the communication path 73 are partitioned from each other by the bonding section 64. The case 61 has a base wall 80, a first wall 81, a second wall 82, a third wall 83, a fourth wall 84, a fifth wall 85, a sixth wall 86, and a seventh wall 87. The air chamber 68 and a portion of the communication path 73 are disposed on the second wall 82 on the opposite side to the containing section 65 side. The containing section 65 is surrounded by the first wall 81, the second wall 82, the third wall 83, and the fourth wall 84 when the base wall 80 is viewed as a planar view from the sheet member 63 side. Here, the fourth wall 84 faces the window section 21 of the second case 7. That is, the part in the tank 9 which has optical transparency is included in the fourth wall 84.

Figure 8:
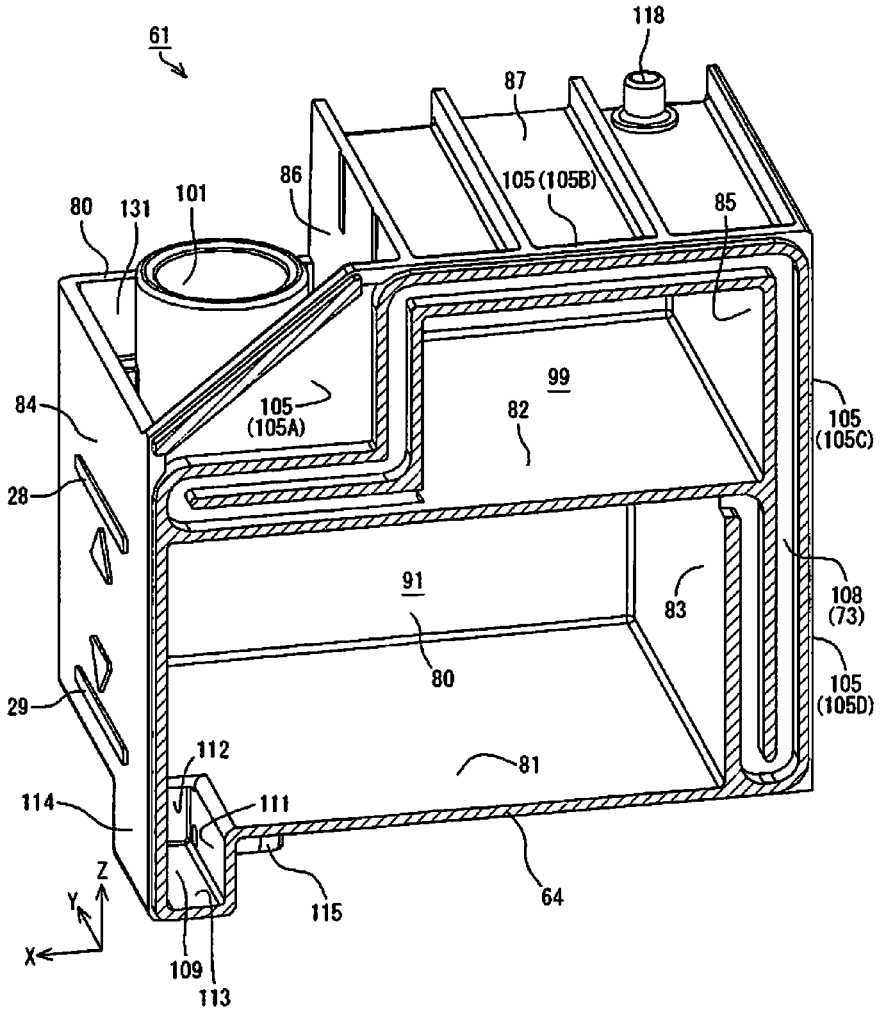
FIG. 8 is a perspective diagram illustrating a case in an embodiment of the present invention.

In addition, the air chamber 68 is surrounded by the second wall 82, the fifth wall 85, the sixth wall 86, and the seventh wall 87 when the base wall 80 is viewed as a planar view from the sheet member 63 side. Here, the base wall 80 of the containing section 65 and the base wall 80 of the air chamber 68 are the same wall. That is, in the present embodiment, the base wall 80 is shared by the containing section 65 and the air chamber 68. The first wall 81, the second wall 82, the third wall 83, and the fourth wall 84 each intersect with the base wall 80 as shown in FIG. 8. The second wall 82 is positioned more to the Z axis direction side than the first wall 81. The first wall 81 and the second wall 82 are opposed to each other so as to interpose the base wall 80. The fourth wall 84 is positioned more to the X axis direction side than the third wall 83. The third wall 83 and the fourth wall 84 are opposed to each other so as to interpose the base wall 80. The third wall 83 intersects with each of the first wall 81 and the second wall 82. The fourth wall 84 also intersects with each of the first wall 81 and the second wall 82.

The first wall 81, the second wall 82, the third wall 83, and the fourth wall 84 protrude from the base wall 80 in the −Y axis direction. Due to this, a recess section 91 is configured using the first wall 81, the second wall 82, the third wall 83, and the fourth wall 84 which extend from the main wall, where the base wall 80 is the main wall, in the −Y axis direction. The recess section 91 is configured with an orientation so as to be recessed toward the Y axis direction. The recess section 91 is open toward the −Y axis direction, that is, toward the sheet member 63 (FIG. 6) side. In other words, the recess section 91 is provided with an orientation so as to be recessed toward the Y axis direction, that is, toward the opposite side to the sheet member 63 (FIG. 6) side. Then, when the sheet member 63 is bonded together with the case 61, the containing section 65 is configured due to the recess section 91 being closed off by the sheet member 63. Here, each of the base wall 80 and the first wall 81 to the seventh wall 87 are not limited to being flat walls and may be walls include irregularities.

The fifth wall 85 protrudes from the second wall 82 toward the opposite side of the second wall 82 to the first wall 81 side, that is, toward the +Z axis direction side of the second wall 82 as shown in FIG. 7. The sixth wall 86 protrudes from the second wall 82 toward the opposite side of the second wall 82 to the first wall 81 side, that is, toward the +Z axis direction side of the second wall 82. The sixth wall 86 is positioned more to the X axis direction side than the fifth wall 85. The fifth wall 85 and the sixth wall 86 are provided at positions which are face to face to each other so as to interpose the air chamber 68. The seventh wall 87 is positioned more to the Z axis direction side than the second wall 82. The second wall 82 and the seventh wall 87 are provided at positions which are face to face to each other so as to interpose the air chamber 68. The fifth wall 85 intersects with each of the second wall 82 and the seventh wall 87. The sixth wall 86 also intersects with each of the second wall 82 and the seventh wall 87.

The fifth wall 85, the sixth wall 86, and the seventh wall 87 protrudes from the base wall 80 in the −Y axis direction as shown in FIG. 8. Due to this, a recess section 99 is configured using the second wall 82, the fifth wall 85, the sixth wall 86, and the seventh wall 87 which extend from the main wall, where the base wall 80 is the main wall, in the −Y axis direction. The recess section 99 is configured with an orientation so as to be recessed toward the Y axis direction. The recess section 99 is open toward the −Y axis direction, that is, toward the sheet member 63 (FIG. 6) side. In other words, the recess section 99 is provided with an orientation so as to be recessed toward the Y axis direction, that is, toward the opposite side to the sheet member 63 (FIG. 6) side. Then, when the sheet member 63 is bonded together with the case 61, the air chamber 68 is configured due to the recess section 99 being closed off by the sheet member 63. Here, the amounts of protruding by the first wall 81 to the seventh wall 87 from the base wall 80 are set to amounts of protruding which are the same to each other.

The third wall 83 and the fifth wall 85 have a difference in levels. The third wall 83 is positioned more to the fourth wall 84 side than the fifth wall 85, that is, more to the X axis direction side than the fifth wall 85. In addition, the fourth wall 84 and the sixth wall 86 have a difference in levels. The sixth wall 86 is positioned more to the third wall 83 side than the fourth wall 84, that is, more to the −X axis direction side than the fourth wall 84. Then, an ink introduction section 101 is provided between the fourth wall 84 and the sixth wall 86 in a state when the base wall 80 is viewed as a planar view from the sheet member 63 side. The ink introduction section 101 is provided in the second wall 82.

An overhang section 105 is provided in the case 61 as shown in FIG. 8. The communication path 73 is provided in the overhang section 105. The overhang section 105 has a part 105A which overhangs from the second wall 82 toward the Z axis direction side along the edge of the opening of the recess section 91 in a region of the second wall 82 which is more to the X axis direction side than the sixth wall 86. The part 105A overhangs from the sixth wall 86 toward the X axis direction side along the edge of the opening of the recess section 99 in the sixth wall 86. In addition, the overhang section 105 has a part 105B which overhangs from the seventh wall 87 toward the Z axis direction side. In addition, the overhang section 105 has a part 105C which overhangs from the fifth wall 85 toward the −X axis direction side along the edge of the opening of the recess section 99 in the fifth wall 85. In addition, the overhang section 105 has a part 105D which overhangs from the third wall 83 toward the −X axis direction side along the edge of the opening of the recess section 91 in the third wall 83. The communication path 73 is configured as a groove 108 which is provided in the overhang section 105 with an orientation so as to be recessed toward the opposite side to the sheet member 63 (FIG. 6) side.

Here, a recess section 109 is provided inside the recess section 91 as shown in FIG. 8. The recess section 109 is surrounded by an eight wall 111, a ninth wall 112, a tenth wall 113, and the fourth wall 84. The recess section 109 is provided with an orientation so as to be recessed from the first wall 81 toward the opposite side of the first wall 81 to the second wall 82, that is, from the first wall 81 to the −Z axis direction side. The eight wall 111 and the ninth wall 112 are each provided in the first wall 81 and protrude from the first wall 81 toward the opposite side of the first wall 81 to the second wall 82, that is, from the first wall 81 to the −Z axis direction side.

The eight wall 111 is positioned between the fourth wall 84 and the third wall 83 and opposes the fourth wall 84 so as to interpose the tenth wall 113. The ninth wall 112 is positioned between the base wall 80 and the sheet member 63 (FIG. 6) and opposes the sheet member 63 so as to interpose the tenth wall 113. The tenth wall 113 is positioned more to the opposite side to the second wall 82 side than the first wall 81, that is, more to the −Z axis direction side than the first wall 81. The tenth wall 113 opposes the second wall 82. The eight wall 111 intersects with the first wall 81, the ninth wall 112, and the tenth wall 113. The ninth wall 112 intersects with the first wall 81, the fourth wall 84, and the tenth wall 113. The tenth wall 113 intersects with the fourth wall 84.

Figure 9:
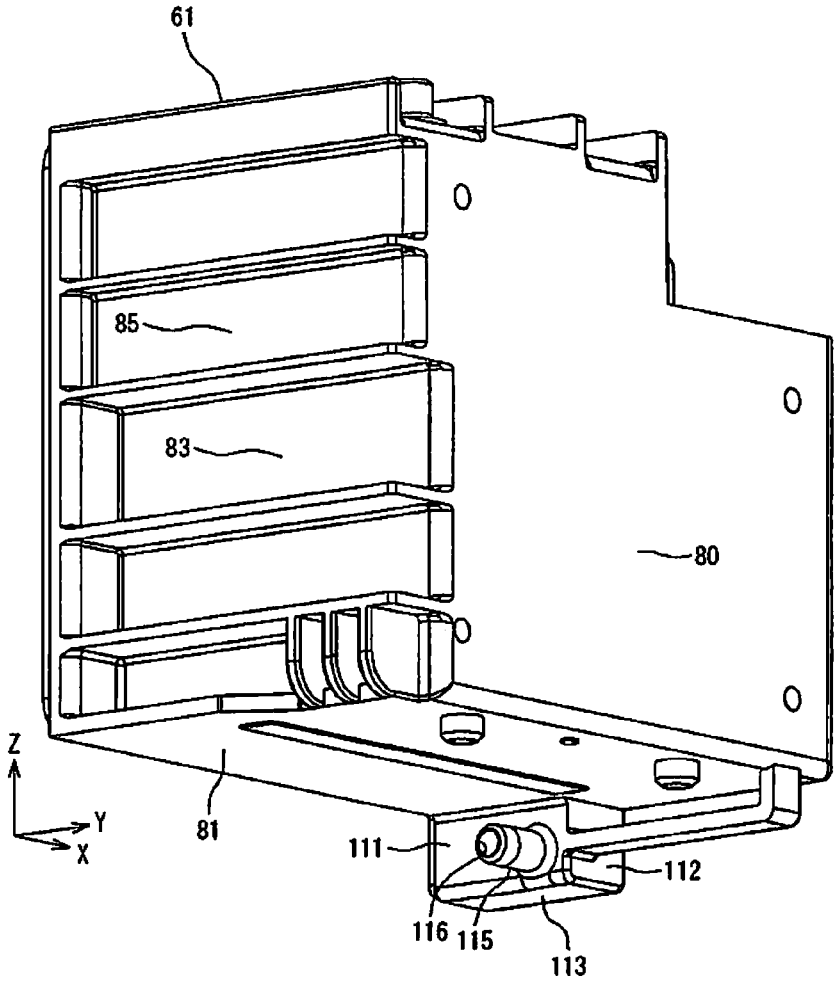
FIG. 9 is a perspective diagram illustrating a case in an embodiment of the present invention.

The eight wall 111, the ninth wall 112, the tenth wall 113, and the fourth wall 84 which surround the recess section 109 configure a supply section 114 as shown in FIG. 8. A connection section 115 is provided in the supply section 114. The connection section 115 is provided in the eight wall 111. The connection section 115 is provided in the eight wall 111 on the opposite side to the recess section 109 side. The connection section 115 protrudes from the eight wall 111 toward the opposite side to the ninth wall 112 side, that is, from the eight wall 111 to the third wall 83 side. The connection section 115 is formed in a cylindrical shape as shown in FIG. 9. A supply opening 116 is formed in the connection section 115. The supply opening 116 is an opening which is formed in the connection section 115 and is an outlet for ink from the tank 9. The supply tube 36 (FIG. 4) is connected with the connection section 115. Ink which is contained in the tank 9 is sent from the connection section 115 to the supply tube 36 through the supply opening 116. Ink which is sent to the supply tube 36 is lead to the printing head 38 by the supply tube 36.

In addition, an air communication opening 118 is provided in the seventh wall 87 as shown in FIG. 8. The air communication opening 118 protrudes from the seventh wall 87 toward the opposite side of the seventh wall 87 to the second wall 82 side, that is, to the Z axis direction side of the seventh wall 87. The air communication opening 118 is provided at a position which overlaps with the recess section 99 when the seventh wall 87 is viewed as a planar view, that is, when the seventh wall 87 is viewed as a planar view over the XY plane. The air communication opening 118 communicates between the outer side of the case 61 and the inner side of the recess section 99. The air communication opening 118 is a flow path for air where it is possible for air from the outer side of the case 61 to be introduced to the inner side of the recess section 99. Here, the bonding section 64 is provided in the case 61 along the contours of each of the recess section 91, the recess section 99, the recess section 109, and the communication path 73.

The sheet member 63 faces the base wall 80 so as to interpose the first wall 81 to the seventh wall 87 as shown in FIG. 6. The sheet member 63 has a size which covers the recess section 91, the recess section 99, the recess section 109, and the overhang section 105 (FIG. 8) in a planar view.

The sheet member 63 is adhered to the bonding section 64. Due to this, the recess section 91, the recess section 99, the recess section 109, and the communication path 73 are sealed using the sheet member 63. For this reason, it is possible for the sheet member 63 to be seen as a lid with regard to the case 61.

The communication path 73 has a communication opening 121 and a communication opening 122 as shown in FIG. 7. The communication opening 121 is an open section which opens toward the inner side of the air chamber 68. The communication opening 122 is an open section which opens toward the inner side of the containing section 65. The air chamber 68 is linked with the containing section 65 from the communication opening 121 through the communication opening 122 via the communication path 73. Due to the above, the containing section 65 is linked with the outside of the tank 9 via the communication path 73, the air chamber 68, and the air communication opening 118. That is, the communication section 67 is link to communicate between the air communication opening 118 and the containing section 65. Air which flows from the air communication opening 118 into the inside of the air chamber 68 flows into the inside of the containing section 65 via the communication path 73.

The ink introduction section 101 is provided in the second wall 82. The ink introduction section 101 is provided inside a recess section 131 which is surrounded by the sixth wall 86, the overhang section 105, the fourth wall 84, and the base wall 80 as shown in FIG. 8. As described previously, the overhang section 105 protrudes more to the seventh wall 87 side than the second wall 82. In addition, the sixth wall 86 also protrudes more to the seventh wall 87 side than the second wall 82. In the same manner, the base wall 80 and the fourth wall 84 also protrude more to the seventh wall 87 side than the second wall 82 in the present embodiment. Then, the overhang section 105 intersects with both the fourth wall 84 and the sixth wall 86. In addition, the base wall 80 intersects with both the fourth wall 84 and the sixth wall 86. For this reason, the region in the second wall 82, which is more to the fourth wall 84 side than the sixth wall 86, configures the recess section 131 which is surrounded by the sixth wall 86, the overhang section 105, the fourth wall 84, and the base wall 80. The recess section 131 is provided with an orientation so as to be recessed from the second wall 82 side toward the first wall 81 side.

Due to the configuration described above, the ink introduction section 101 is surrounded by the sixth wall 86, the overhang section 105, the fourth wall 84, and the base wall 80. In other words, the ink introduction section 101 is provided inside a region in the second wall 82 which is surrounded by the sixth wall 86, the overhang section 105, the fourth wall 84, and the base wall 80. Then, the recess section 131 has a function as an ink receiving section. It is possible for the ink receiving section to, for example, receive ink which has leaked out from the ink introduction section 101 and ink which drips down during insertion. In this manner, the recess section 131 has a function as the ink receiving section which receives ink.

Figure 10:
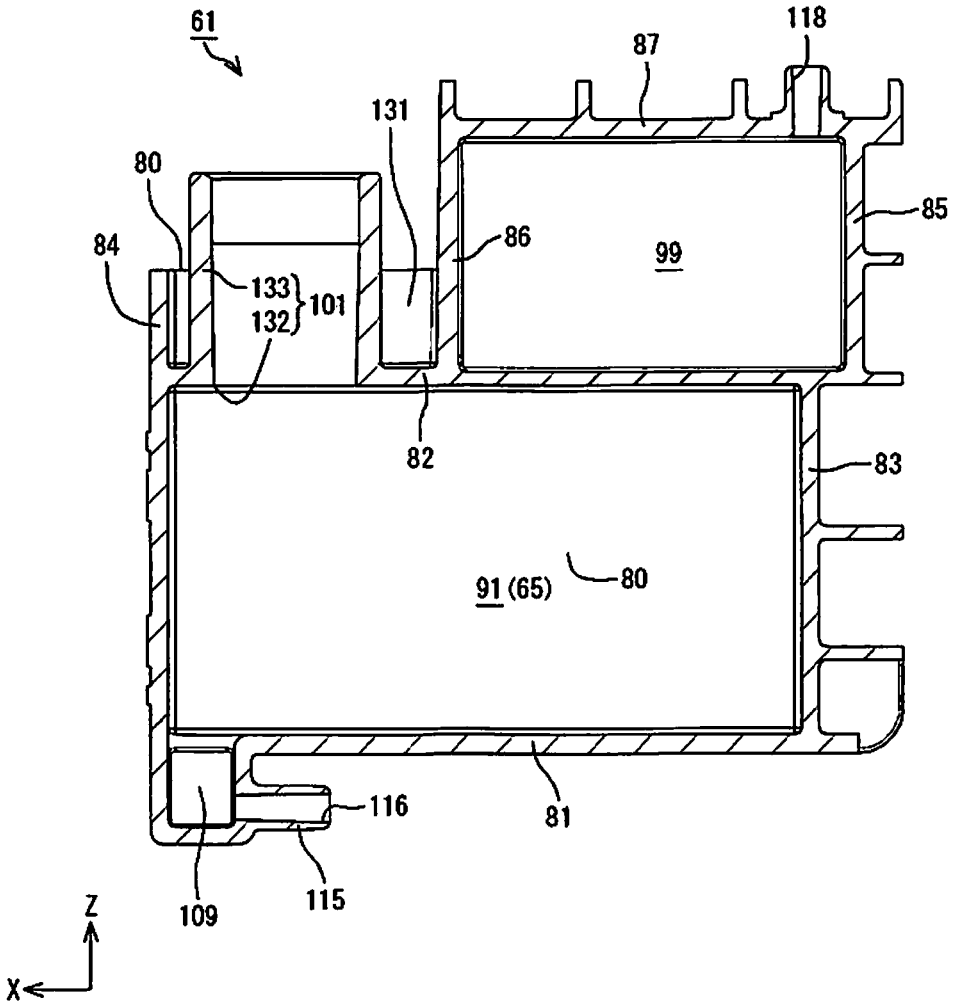
FIG. 10 is a cross sectional diagram when an ink introduction opening, a supply opening, and an air communication opening in an embodiment of the present invention are cut along an XY plane.

The ink introduction section 101 has an opening 132 and a side wall 133 as shown in FIG. 10 which is a cross sectional diagram when the ink introduction section 101, the supply opening 116, and the air communication opening 118 are cut along the XZ plane. The opening 132 is a through hole which is provided in the second wall 82. The opening 132 is an intersection section where the ink introduction section 101 and the recess section 91 (the containing section 65) intersect. It is possible to also adopt a configuration where the side wall 133 protrudes to the inner side of the recess section 91 (the containing section 65) as the configuration of the ink introduction section 101. Even with a configuration where the side wall 133 protrudes to the inner side of the recess section 91 (the containing section 65), the intersection section where the ink introduction section 101 and the recess section 91 (the containing section 65) intersect is defined as the opening 132. The recess section 91 is linked with the outer side of the recess section 91 via the opening 132 which is a through hole. The side wall 133 is provided on the second wall 82 on the opposite side to the first wall 81 side, surrounds the periphery of the opening 132, and forms the ink introduction path. The side wall 133 protrudes from the second wall 82 toward the opposite side to the first wall 81 side. Here, in the present embodiment, the side wall 133 protrudes more to the opposite side to the first wall 81 side than each of the base wall 80 and the fourth wall 84. It is possible for prevent ink which is held in the recess section 131 from flowing into the opening 132 due to the side wall 133.

Figure 11:
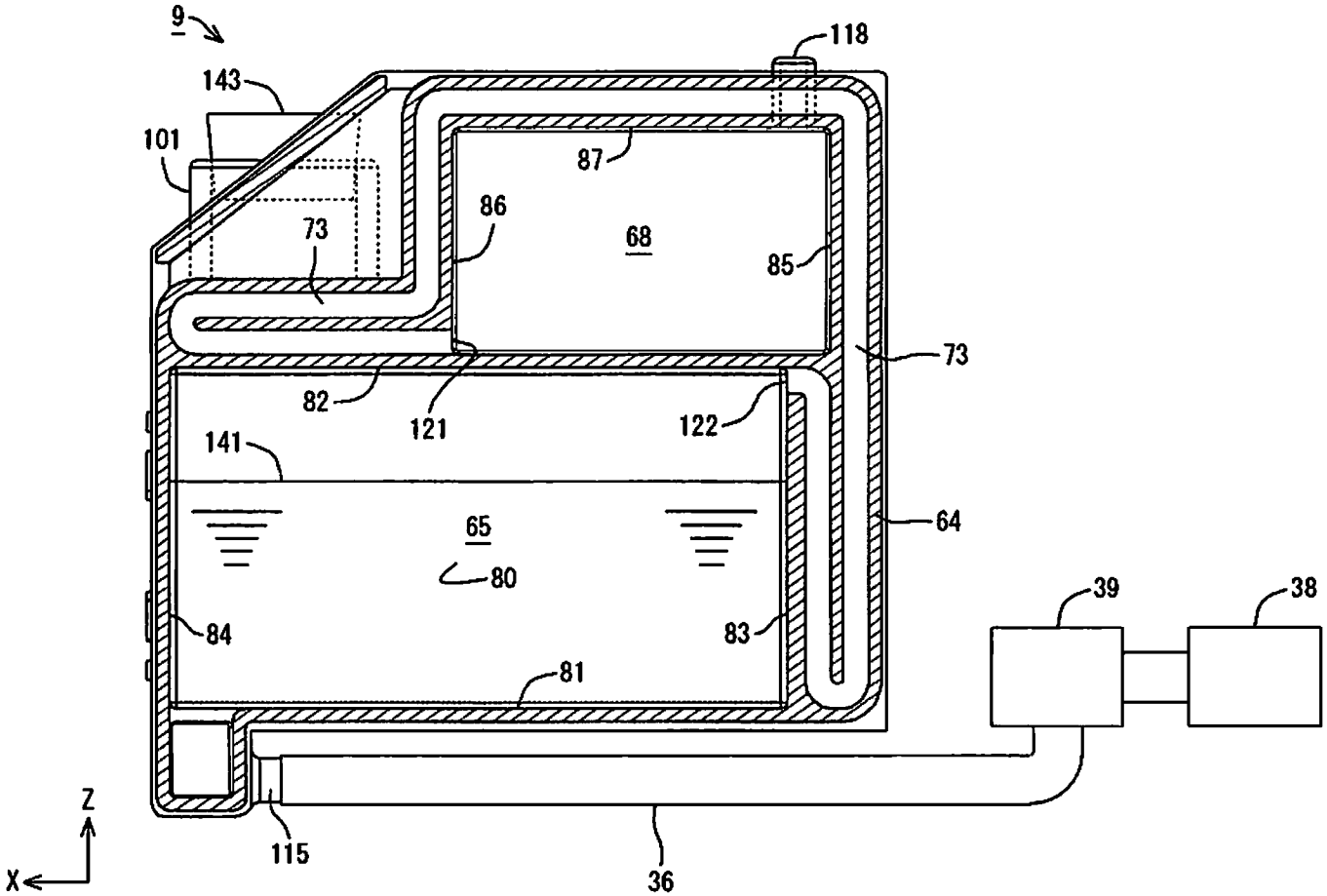
FIG. 11 is a side surface diagram when a tank in an embodiment of the present invention is viewed from a sheet member side.

Ink 141 is contained in the tank 9 in an inner section of the containing section 65 as shown in FIG. 11 which is a side surface diagram when the tank 9 is viewed from the sheet member 63 side. In FIG. 11, illustration of the sheet member 63 is omitted and shading is carried out for the bonding section 64 so that it is easy for the configuration to be clearly seen. The ink 141 inside the containing section 65 is supplied from the supply opening 116 (FIG. 10) which is formed in the connection section 115 to the printing head 38. In the present embodiment, the supply tube 36 is connected with the supply opening 116 and there is a cap 143 on the ink introduction section 101 in a state where the ink ejecting system 1 is being used for printing. The ink 141 inside the containing section 65 reaches from the supply opening 116 to the printing head 38 due to suction inside the supply tube 36 via the relay unit 39.

The ink 141 inside the containing section 65 is sent to the printing head 38 side in accompaniment with printing using the printing head 38. For this reason, pressure inside the containing section 65 is lower than air pressure in accompaniment with printing using the printing head 38. When pressure inside the containing section 65 is lower than air pressure, air inside the containing section 65 flows into the inside of the containing section 65 through the communication path 73. Due to this, it is easy for pressure inside the containing section 65 to be maintained at air pressure. Due to the above, the ink 141 inside the tank 9 is supplied to the printing head 38. When the ink 141 inside the containing section 65 in the tank 9 is consumed and the remaining amount of the ink 141 becomes low, it is possible for an operator to replenish new ink into the inside of the containing section 65 from the ink introduction section 101.

Figure 12:
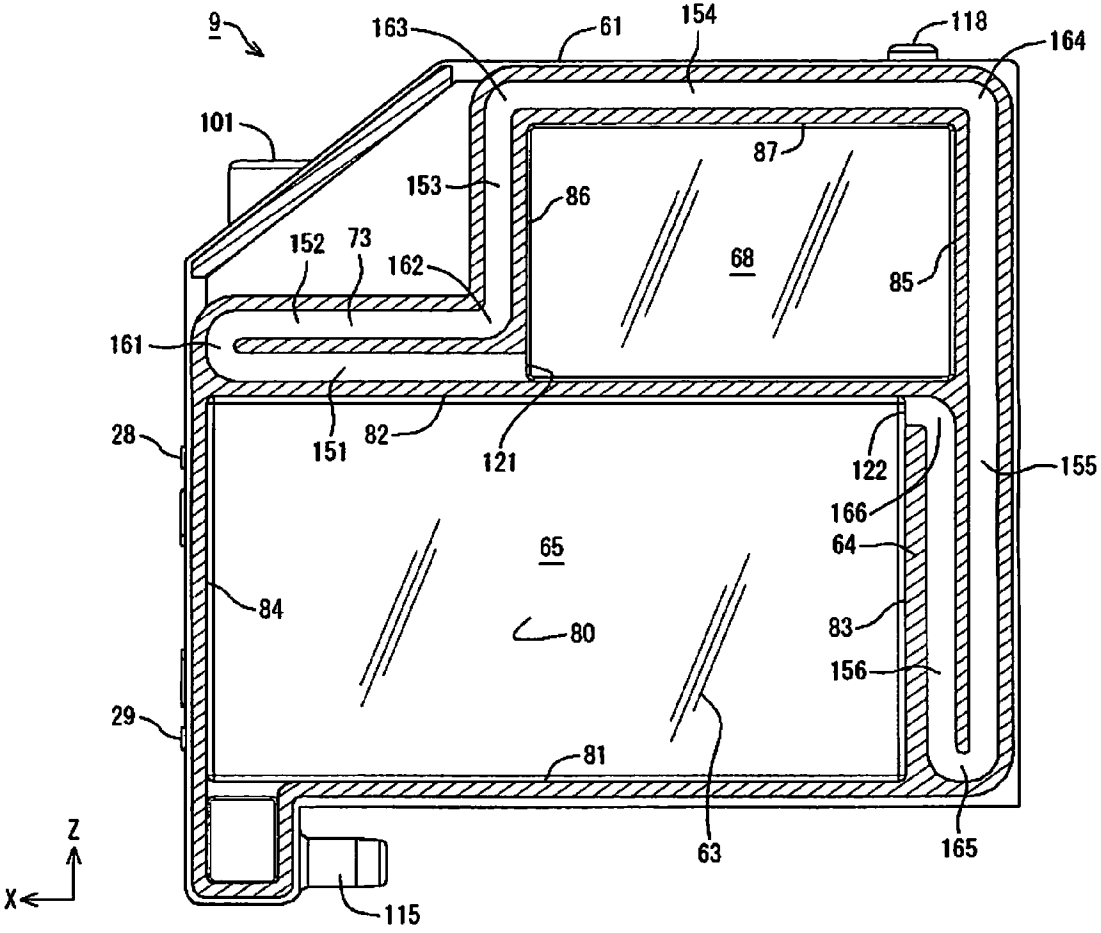
FIG. 12 is a side surface diagram when a tank in an embodiment of the present invention is viewed from a sheet member side.

It is possible for the communication path 73 to be segmented into a first flow path 151, a second flow path 152, a third flow path 153, a fourth flow path 154, a fifth flow path 155, and a sixth flow path 156 as shown in FIG. 12. The first flow path 151 is toward the fourth wall 84 along the second wall 82, that is, along the X axis direction with the communication opening 121 as a starting point. The first flow path 151 reaches from the communication opening 121 to a reverse section 161. The reverse section 161 is a part where the orientation of the flow path which is the communication path 73 is reversed. The orientation of the flow path is reversed from the X axis direction to the −X axis direction at the reverse section 161. Here, in the flow path for air which reaches from the air communication opening 118 to the containing section 65, the air communication opening 118 side is set as the upstream side and the communication opening 122 side is set as the downstream side.

The second flow path 152 is from the reverse section 161 toward the sixth wall 86 along the extending direction of the first flow path 151, that is, along the −X axis direction. The second flow path 152 reaches from the reverse section 161 to a curve section 162. The curve section 162 is a part where the orientation of the flow path which is the communication path 73 is curved. The orientation of the flow path is curved from the −X axis direction to the Z axis direction at the curve section 162. The third flow path 153 is from the curve section 162 toward the seventh wall 87 along the sixth wall 86, that is, along the Z axis direction. The third flow path 153 reaches from the curve section 162 to a curve section 163. The curve section 163 is a part where the orientation of the flow path which is the communication path 73 is curved. The orientation of the flow path is curved from the Z axis direction to the −X axis direction at the curve section 163.

The fourth flow path 154 is from the curve section 163 toward the fifth wall 85 along the seventh wall 87, that is, along the −X axis direction. The fourth flow path 154 is positioned more to the Z axis direction side (above) than the air chamber 68. The fourth flow path 154 reaches from the curve section 163 to a curve section 164. The curve section 164 is a part where the orientation of the flow path which is the communication path 73 is curved. The orientation of the flow path is curved from the −X axis direction to the −Z axis direction at the curve section 164. The fifth flow path 155 is from the curve section 164 toward the first wall 81 along the fifth wall 85, that is, along the −Z axis direction. The fifth flow path 155 reaches from the curve section 164 to a reverse section 165.

As described above, the fourth flow path 154 is positioned above the air chamber 68. That is, a portion of the communication path 73 is positioned above the air chamber 68. According to this configuration, it is difficult for ink, which flows from the containing section 65 into the inside of the communication path 73, to rise up above the air chamber 68 due to the action of gravity. For this reason, it is difficult for ink, which flows from the containing section 65 into the inside of the communication path 73, to reach the air chamber 68. As a result, it is easy to suppress ink, which flows from the containing section 65 into the inside of the communication path 73, to leak out from the tank 9.

In addition, the third flow path 153 and the fifth flow path 155 are positioned in the tank 9 on opposite sides to each other so as to interpose the air chamber 68. According to this configuration, it is possible for the flow path of the communication path 73 to be lengthened due to the communication path 73 being formed so as to wind around the periphery of the air chamber 68 by utilizing the space in the periphery of the air chamber 68. Lengthening of the flow path of the communication path 73 is preferable from the point of view that it is difficult for the liquid component of ink inside the containing section 65 to evaporate, from the point of view that it is difficult for ink which flows from the containing section 65 into the inside of the communication path 73 to reach the air chamber 68, and the like.

The reverse section 165 is a part where the orientation of the flow path which is the communication path 73 is reversed. The orientation of the flow path is reversed from the −Z axis direction to the +Z axis direction at the reverse section 165. The sixth flow path 156 is from the reverse section 165 toward the second wall 82 along the third wall 83, that is, along the Z axis direction. The sixth flow path 156 reaches from the reverse section 165 to the communication opening 122 through a curve section 166. The curve section 166 is a part where the orientation of the flow path which is the communication path 73 is curved. The communication path 73 is linked with the inside of the containing section 65 via the communication opening 122 with the orientation of the flow path curved from the +Z axis direction to the X axis direction at the curve section 166.

Figure 13:
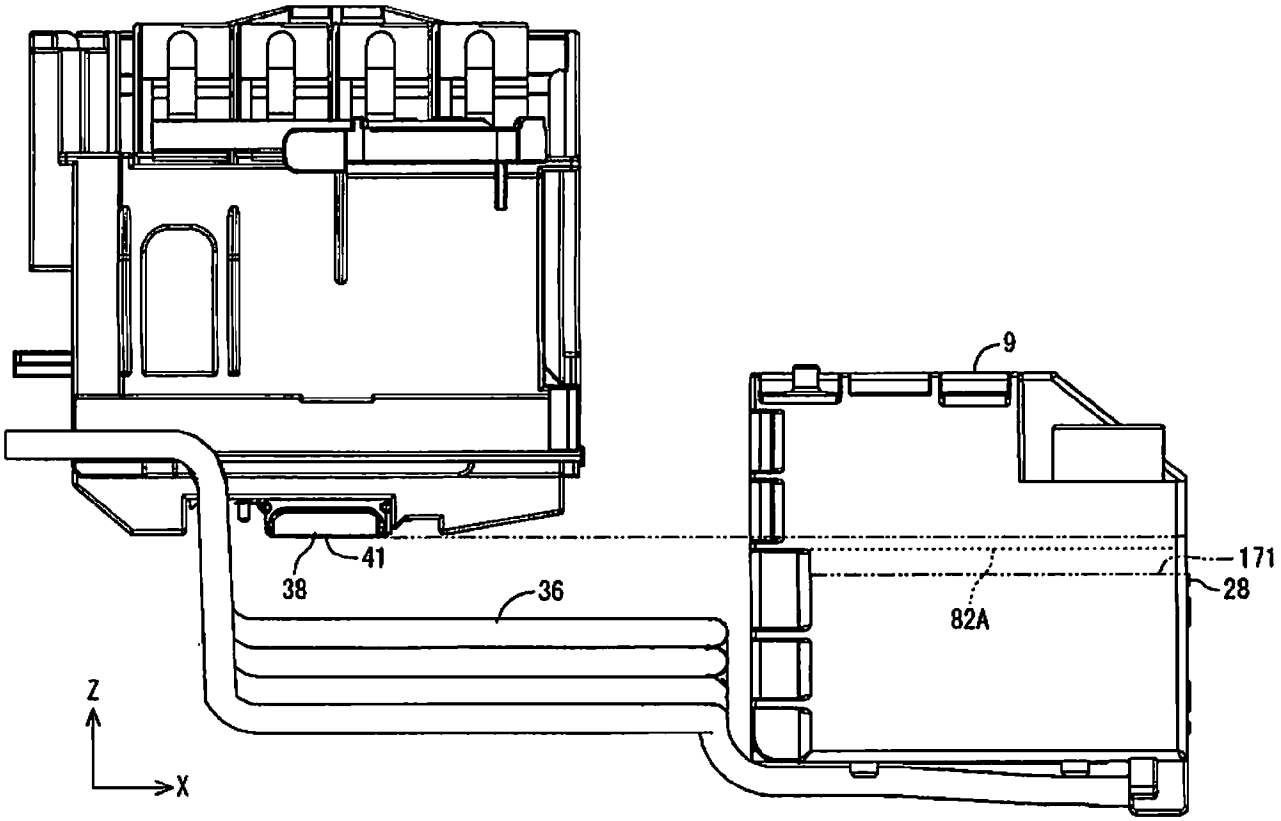
FIG. 13 is a front surface diagram illustrating a printing head and a tank in an embodiment of the present invention.

In the present embodiment, the nozzle surface 41 of the printing head 38 is positioned above the upper limit mark 28 in the tank 9 as shown in FIG. 13 with the liquid ejecting system 1 in a posture in a state of being used where the liquid ejecting system 1 is placed along a flat horizontal surface (referred to as usage posture). For this reason, as long as the amount of ink inside the tank 9 does not surpass the upper limit, a liquid surface 171 of the ink inside the tank 9 is positioned below the nozzle surface 41. For this reason, the head of water in the tank 9 is lower than the head of water in the printing head 38. Due to this, it is easy to suppress the liquid in the vicinity of the nozzles 42 (FIG. 5) from being pressurized by the ink which is contained in the tank 9. As a result, it is possible to suppress ink from flowing out from the nozzles 42. Furthermore, the nozzle surface 41 is positioned above an inner wall 82A of the second wall 82 in the present embodiment. For this reason, the liquid surface 171 of the ink is positioned below the nozzle surface 41 even when ink is introduced into the inside of the tank 9 to surpass the upper limit mark 28. Due to this, it is possible to further suppress ink from flowing out from the nozzles 42.

Embodiments of the positioning of the tank 9 with regard to the printing head 38 will be described. Here, the embodiment of the positioning of the tank 9 with regard to the printing head 38 along the Y axis will be described.

Embodiment 1

Figure 14:
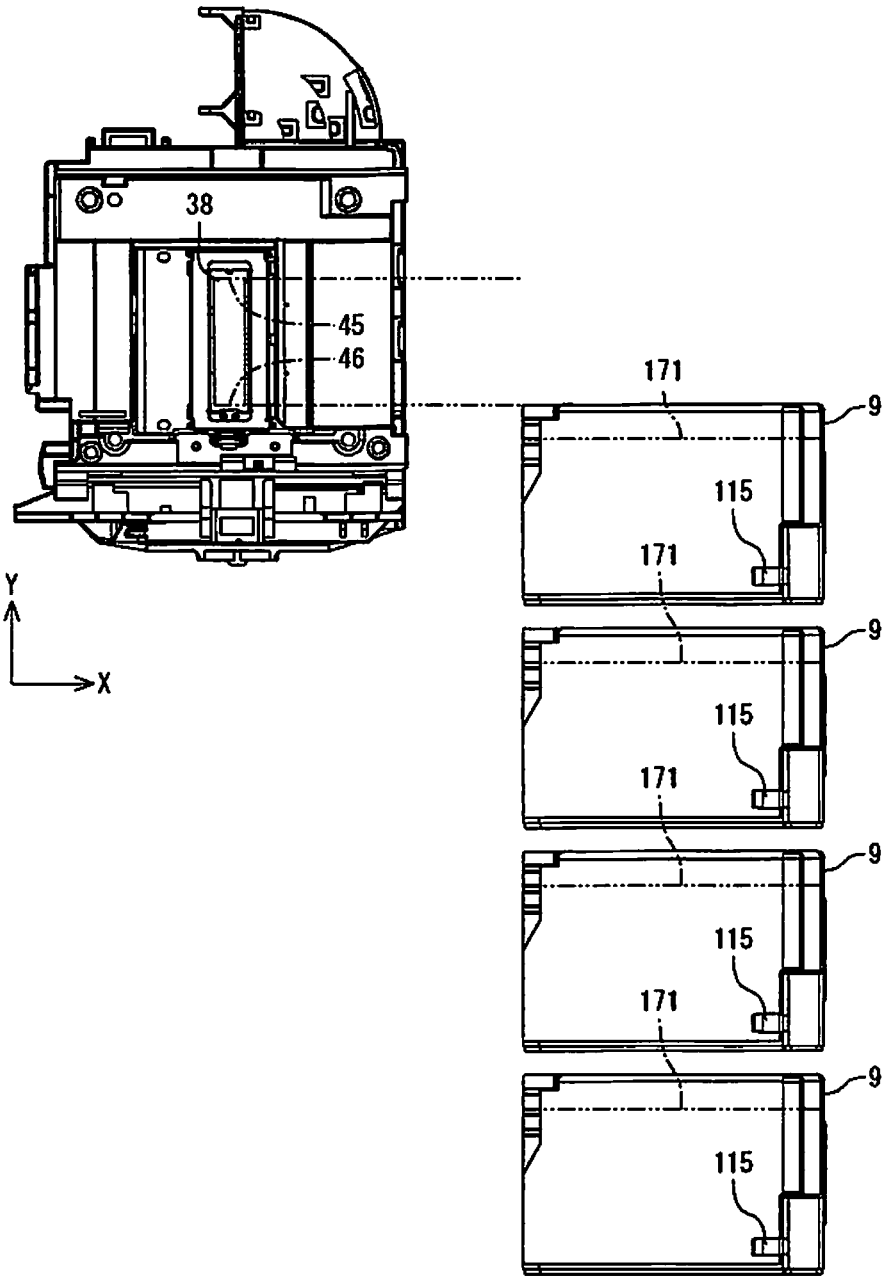
FIG. 14 is a bottom surface diagram illustrating a printing head and a tank in Embodiment 1.

In Embodiment 1, in a first posture where the front surface 13 of the liquid ejecting system 1 which is shown in FIG. 1 faces vertically upward, the four tanks 9 are disposed so that the liquid surface 171 of the ink inside the tanks 9 is lower than the rear end 46 of the nozzle formation section 44 of the nozzle surface 41 as shown in FIG. 14. Here, in the first posture, the Y axis direction is the vertically upward direction and the −Y axis direction is the vertically downward direction. In the first posture, the plurality of nozzles 42 which are shown in FIG. 5 face in the horizontal direction and the front end 45 of the nozzle formation section 44 is positioned above the rear end 46.

In Embodiment 1, the liquid surface 171 of the ink is positioned below the plurality of nozzles 42 (FIG. 5) since the tanks 9 are disposed so that the liquid surface 171 of the ink inside the tanks 9 is lower than the rear end 46 of the nozzle formation section 44 in the first posture. For this reason, the head of water in the tanks 9 is lower than the head of water in the printing head 38. Due to this, it is easy to suppress the ink in the vicinity of the nozzles 42 from being pressurized by the ink which is contained in the tanks 9. As a result, it is possible to suppress ink from flowing out from the nozzles 42. Due to this, it is possible to reduce the possibility that ink flows out from the nozzles 42 even when the flow path for ink between the tanks 9 and the printing head 38 is not closed off in the first posture.

Figure 15:
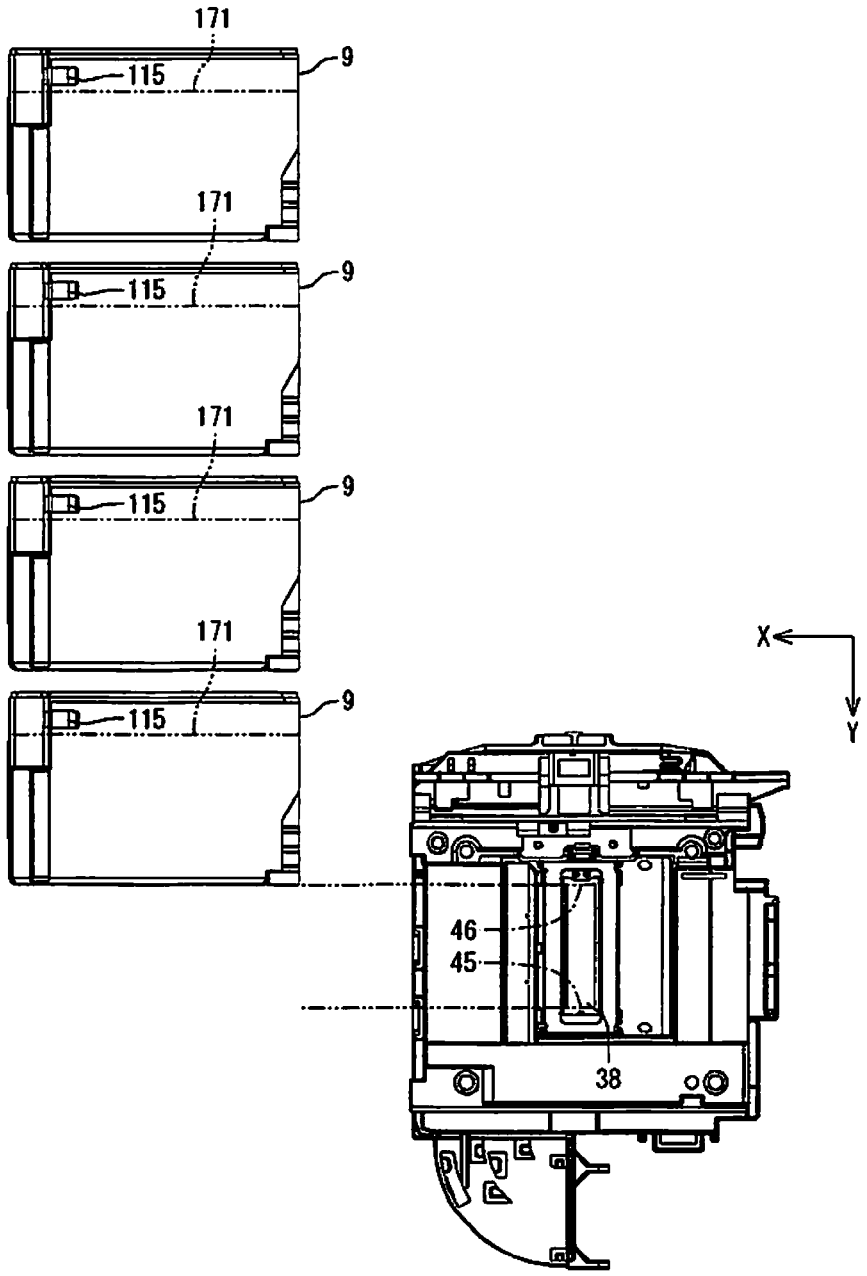
FIG. 15 is a bottom surface diagram illustrating a printing head and a tank in Embodiment 1.

Furthermore, the tanks 9 are disposed in Embodiment 1 at positions so that the liquid surface 171 inside the tanks 9 is higher than the rear end 46 of the nozzle formation section 44 of the nozzle surface 41 as shown in FIG. 15 in a second posture where the front surface 13 of the liquid ejecting system 1 which is shown in FIG. 1 faces vertically downward. Furthermore, the tanks 9 are disposed in the second posture so that the connection sections 115 of the tanks 9 are higher than the liquid surface 171. Here, in the second posture, the −Y axis direction is the vertically upward direction and the Y axis direction is the vertically downward direction. In the second posture, the plurality of nozzles 42 which are shown in FIG. 5 face in the horizontal direction and the front end 45 of the nozzle formation section 44 is positioned below the rear end 46.

In Embodiment 1, the connection sections 115 of the tanks 9 are higher than the liquid surface 171 even when the liquid surface 171 is higher than the nozzle formation section 44 in the second posture. That is, in Embodiment 1, the supply openings 116 (FIG. 9) of the tanks 9 are higher than the liquid surface 171 even when the liquid surface 171 is higher than the nozzle formation section 44 in the second posture. Due to this, it is easy for pressure due to the head of water of the ink which is contained in the tanks 9 to block the liquid supply openings 116. For this reason, it is easy to suppress the ink in the vicinity of the nozzles 42 from being pressurized by the ink which is contained in the tanks 9. As a result, it is possible to suppress ink from flowing out from the nozzles 42. For this reason, in Embodiment 1, it is possible to reduce the possibility that ink flows out from the nozzles 42 even when the flow path for ink between the tanks 9 and the printing head 38 is not closed off in the second posture.

In Embodiment 1 described above, the four tanks 9 which configure the tank unit 5 correspond to the liquid containers. In Embodiment 1, the four tanks 9 which configure the tank unit 5 are provided independently to each other. However, the configuration of the tank unit 5 is not limited to this. It is possible to adopt a configuration as the configuration of the tank unit 5 where, for example, the four tanks 9 which configure the tank unit 5 are integrated. As the configuration where the four tanks 9 are integrated, it is possible to adopt a configuration where, for example, the four tanks 9 are integrated by being linked (bonded) together. In addition, as the configuration where the four tanks 9 are integrated, it is also possible to adopt a configuration where, for example, the four tanks 9 are integrally formed in an integral formation or the like and the inner sections are partitioned into four chambers. In this case, each of the four chambers which are configured due to the inner section being partitioned corresponds to the liquid containing sections. In addition, the number of the liquid containers and the liquid containing sections may be a plurality (two or more) or may be just one.

Embodiment 2

Figure 16:
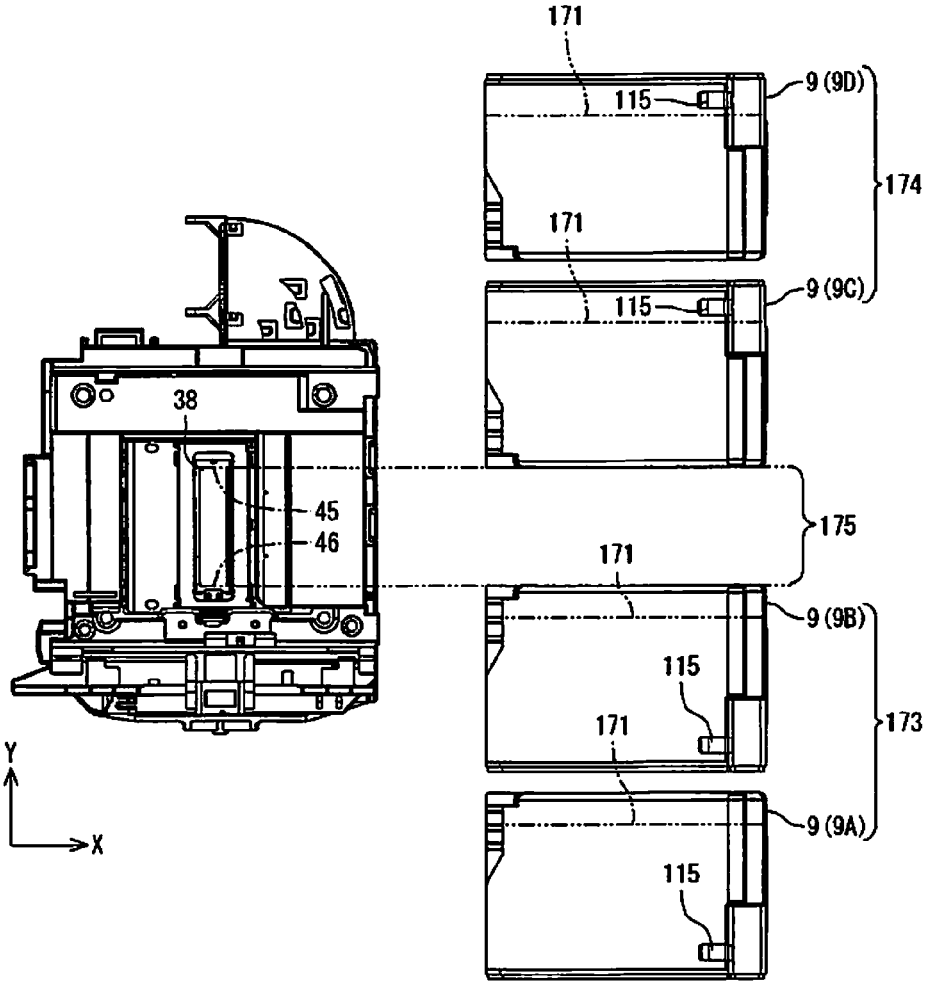
FIG. 16 is a bottom surface diagram illustrating a printing head and a tank in Embodiment 2.

In Embodiment 2, the four tanks 9 are segmented into a first group 173 and a second group 174 as shown in FIG. 16. In Embodiment 2, two of the tanks 9 which are a tank 9A and a tank 9B out of the four tanks 9 belong to the first group 173. In addition, two of the tanks 9 which are a tank 9C and a tank 9D out of the four tanks 9 belong to the second group 174. In Embodiment 2, the tank 9A and the tank 9B are disposed so that the liquid surface 171 of the ink inside the tanks 9 which belong to the first group 173 is lower than the rear end 46 of the nozzle formation section 44 of the nozzle surface 41 in the first posture. In addition, the tank 9C and the tank 9D are disposed at positions so that the liquid surface 171 of the ink inside the tanks 9 which belong to the second group 174 is higher than the front end 45 of the nozzle formation section 44 in the first posture. Furthermore, the tank 9C and the tank 9D are disposed so that the connection sections 115 of the tanks 9 which belong to the second group 174 are higher than the liquid surface 171 in the first posture.

In Embodiment 2, the tank 9A and the tank 9B are disposed so that the liquid surface 171 of the ink inside the tanks 9 which belong to the first group 173 is lower than the rear end 46 of the nozzle formation section 44 in the first posture. For this reason, the liquid surface 171 of the ink in the tank 9A and the tank 9B is positioned below the plurality of nozzles 42 (FIG. 5). As such, the head of water in the tank 9A and the tank 9B is lower than the head of water in the printing head 38. Due to this, it is easy to suppress the ink in the vicinity of the nozzles 42 from being pressurized by the ink which is contained in the tank 9A and the tank 9B. As a result, it is possible to suppress ink from flowing out from the nozzles 42.

Furthermore, in Embodiment 2, the connection sections 115 of the tanks 9 are higher than the liquid surface 171 even when the liquid surface 171 inside the tanks 9 which belong to the second group 174 is higher than the nozzle formation section 44 in the first posture. That is, in Embodiment 2, the supply openings 116 (FIG. 9) of the tanks 9 are higher than the liquid surface 171 even when the liquid surface 171 inside the tanks 9 which belong to the second group 174 is higher than the nozzle formation section 44 in the first posture. Due to this, it is easy for pressure due to the head of water of the ink which is contained in the tank 9C and the tank 9D to block the liquid supply openings 116. For this reason, it is easy to suppress the ink in the vicinity of the nozzles 42 from being pressurized by the ink which is contained in the tank 9C and the tank 9D. As a result, it is possible to suppress ink from flowing out from the nozzles 42. As a result of the above, in Embodiment 2, it is possible to reduce the possibility that ink flows out from the nozzles 42 even when the flow path for ink between the tanks 9 and the printing head 38 is not closed off in the first posture.

Figure 17:
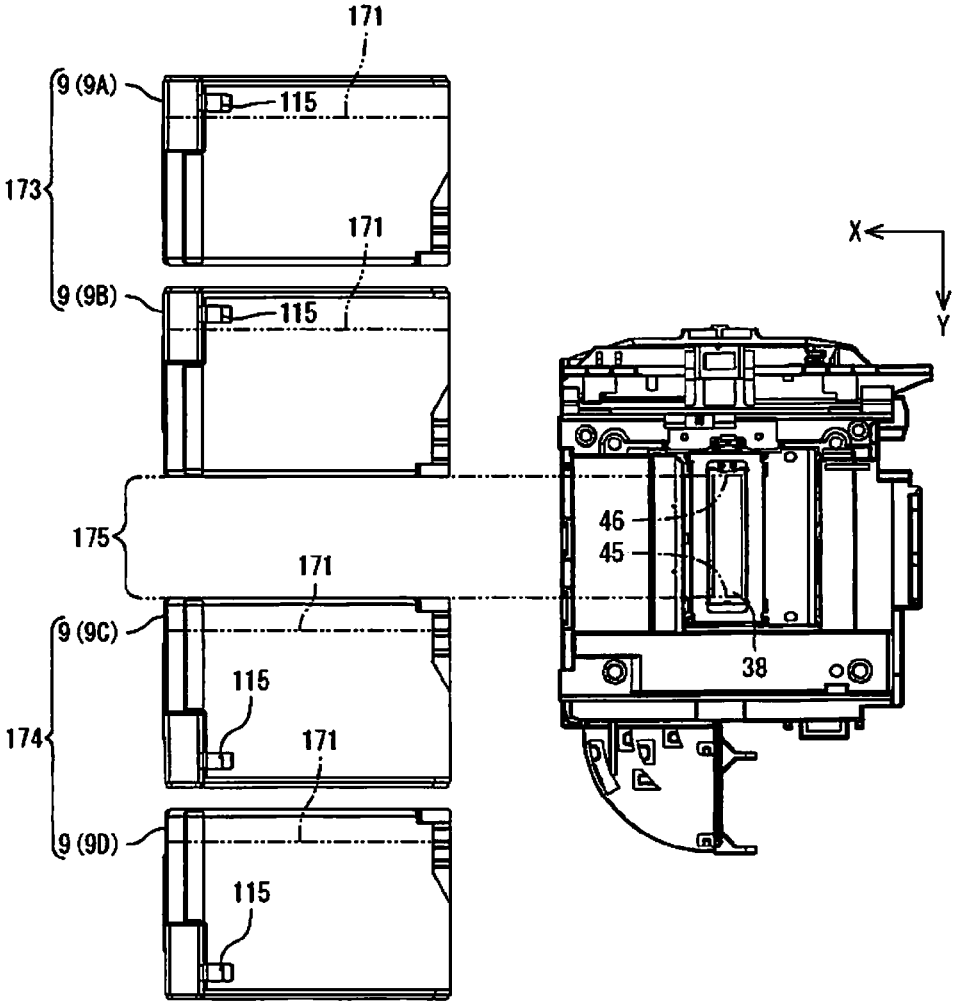
FIG. 17 is a bottom surface diagram illustrating a printing head and a tank in Embodiment 2.

Furthermore, in Embodiment 2, the tank 9C and the tank 9D are disposed so that the liquid surface 171 of the ink inside the tanks 9 which belong to the second group 174 is lower than the front end 45 of the nozzle formation section 44 of the nozzle surface 41 in the second posture as shown in FIG. 17. In addition, the tank 9A and the tank 9B are disposed at positions so that the liquid surface 171 of the ink inside the tanks 9 which belong to the first group 173 is higher than the rear end 46 of the nozzle formation section 44 in the second posture. Furthermore, the tank 9A and the tank 9B are disposed so that the connection sections 115 of the tanks 9 which belong to the first group 173 are higher than the liquid surface 171 in the second posture.

In Embodiment 2, the tank 9C and the tank 9D are disposed so that the liquid surface 171 of the ink inside the tanks 9 which belong to the second group 174 is lower than the front end 45 of the nozzle formation section 44 in the second posture. For this reason, the liquid surface 171 of the ink in the tank 9C and the tank 9D is positioned below the plurality of nozzles 42 (FIG. 5). As such, the head of water in the tank 9C and the tank 9D is lower than the head of water in the printing head 38. Due to this, it is easy to suppress the ink in the vicinity of the nozzles 42 from being pressurized by the ink which is contained in the tank 9C and the tank 9D. As a result, it is possible to suppress ink from flowing out from the nozzles 42.

Furthermore, in Embodiment 2, the connection sections 115 of the tanks 9 are higher than the liquid surface 171 even when the liquid surface 171 inside the tanks 9 which belong to the second group 174 is higher than the nozzle formation section 44 in the second posture. That is, in Embodiment 2, the supply openings 116 (FIG. 9) of the tanks 9 are higher than the liquid surface 171 even when the liquid surface 171 inside the tanks 9 which belong to the first group 173 is higher than the nozzle formation section 44 in the second posture. Due to this, it is easy for pressure due to the head of water of the ink which is contained in the tank 9A and the tank 9B to block the liquid supply openings 116. For this reason, it is easy to suppress the ink in the vicinity of the nozzles 42 from being pressurized by the ink which is contained in the tank 9A and the tank 9B. As a result, it is possible to suppress ink from flowing out from the nozzles 42. As a result of the above, in Embodiment 2, it is possible to reduce the possibility that ink flows out from the nozzles 42 even when the flow path for ink between the tanks 9 and the printing head 38 is not closed off in the second posture.

In the aspects which are realized in the configuration in Embodiment 2 described above, the tanks 9 which belong to the first group 173 and the tanks 9 which belong to the second group 174 are disposed in a symmetrical manner so as to interpose the nozzle formation section 44 of the printing head 38. The tanks 9 which belong to the first group 173 and the tanks 9 which belong to the second group 174 are positioned in a symmetrical manner to each other so as to interpose the nozzle formation section 44 of the printing head 38 along the Y axis. From another point of view, the tanks 9 which belong to the first group 173 and the tanks 9 which belong to the second group 174 are symmetrical with regard to a hypothetical region 175 where a region between the front end 45 and the rear end 46 of the nozzle formation section 44 extends in a direction (a direction which extends in the X axis) which intersects with the front and rear direction (a direction which extends in the Y axis) which is a direction which links the front end 45 and the rear end 46. That is, the tanks 9 which belong to the first group 173 and the tanks 9 which belong to the second group 174 are positioned in a symmetrical manner with regard to the hypothetical region 175.

By adopting this way of disposing the tanks 9 in Embodiment 2, it is possible to reduce the possibility that ink flows out from the nozzles 42 even when the flow path for ink between the tanks 9 and the printing head 38 is not closed off in both the first posture (FIG. 16) and the second posture (FIG. 17). In addition, by adopting this way of disposing the tanks 9, it is possible for the tanks 9 which belong to the first group 173 and the tanks 9 which belong to the second group 174 to be disposed to line up in the front and rear direction so as to interpose the printing head 38. Here, in Embodiment 2, the tanks 9 which belong to the first group 173 correspond to the first liquid containing section and the tanks 9 which belong to the second group 174 correspond to the second liquid containing section. In addition, in Embodiment 2, the number of the tanks 9 which belong to the first group 173 and the number of the tanks 9 which belong to the second group 174 are not limited to two and may be one or may be three or more.

In Embodiment 2, the four tanks 9 which configure the tank unit 5 are provided to be independent from each other. However, the configuration of the tank unit 5 is not limited to this. It is possible to adopt a configuration as the configuration of the tank unit 5 where, for example, the four tanks 9 which configure the tank unit 5 are integrated. As the configuration where the four tanks 9 are integrated, it is possible to adopt a configuration where, for example, the four tanks 9 are integrated by being linked (bonded) together. In addition, as the configuration where the four tanks 9 are integrated, it is also possible to adopt a configuration where, for example, the four tanks 9 are integrally formed in an integral formation or the like and the inner sections are partitioned into four chambers. In this case, each of the four chambers which are configured due to the inner section being partitioned corresponds to the liquid containing sections. In addition, the number of the liquid containers and the liquid containing sections may be a plurality (two or more) or may be just one.

In each of the embodiments described above, the liquid ejecting apparatus may be a liquid ejecting apparatus which consumes a liquid other than ink due to the liquid being ejected, discharged, or applied. Here, as states of the liquid which is discharged from the liquid ejecting apparatus as liquid droplets which are extremely small amounts, granular shapes, tear shapes, and drawn-out thread shapes are included. Here, it is sufficient if the liquid is a material which it is able to be consumed by the liquid ejecting apparatus. For example, it is sufficient if the liquid is in a state when a substance is in a liquid phase and includes liquids with high or low viscosity, sols, gels, and other fluids such as inorganic solvents, organic solvents, solutions, liquid resins, and liquid metals (molten metals). In addition, not only liquids where a substance is in one state but also particles of a functional material which are formed of solid matter such as pigments and metal particles being dissolved, dispersed, or mixed into a solvent and the like are also included. As a typical example of the liquids other than ink which is described in the embodiments described above, liquid crystals and the like can be exemplified. Here, ink encompasses various types of liquid compositions such as typical water-based inks and oil-based inks, gel inks, and hot melt inks. As detailed examples of liquid ejecting apparatuses, there are, for example, liquid ejecting apparatuses which eject liquid, which include electrode materials or materials such as colorants having been dispersed or dissolved, which are used in the manufacturing of liquid crystal displays, EL (electro luminescent) displays, field emission displays, color filters, and the like. In addition, the liquid ejecting apparatuses may be liquid ejecting apparatuses which eject bioorganic material which is used in manufacturing biochips, liquid ejecting apparatuses which are used as precision pipettes and which eject liquid samples, textile printing apparatus, micro dispensers, or the like. Furthermore, the liquid ejecting apparatuses may be liquid ejecting apparatuses which eject lubricating oil in a pin point manner in precision machinery such as clocks and cameras or liquid ejecting apparatuses which eject a transparent resin liquid such as an ultraviolet curing resin liquid onto a substrate in order to form a small semispherical lens (an optical lens) which is used in optical communication elements or the like. In addition, the liquid ejecting apparatuses may be liquid ejecting apparatuses which eject an etching liquid such as an acid or an alkali in order to carry out etching on a substrate or the like.

DESCRIPTION OF REFERENCE NUMERALS

1 LIQUID EJECTING SYSTEM, 3 PRINTER, 5 TANK UNIT, 6 FIRST CASE, 7 SECOND CASE, 9 TANK, 10 CONSTITUENT UNIT, 11 SHEET DISCHARGE SECTION, 13 FRONT SURFACE, 15 UPPER SURFACE, 17 OPERATION PANEL, 18A POWER SOURCE BUTTON, 18B OPERATION BUTTON, 19 SIDE SECTION, 21 WINDOW SECTION, 23 FRONT SURFACE, 25 UPPER SURFACE, 27 SIDE SECTION, 28 UPPER LIMIT MARK, 29 LOWER LIMIT MARK, 31 ATTACHMENT PIN, 32 SUPPORT FRAME, 33 ATTACHMENT PIN, 35 PRINTING SECTION, 36 SUPPLY TUBE, 37 CARRIAGE, 38 PRINT-

ING HEAD, 39 RELAY UNIT, 41 NOZZLE SURFACE, 42 NOZZLE, 43 NOZZLE ROW, 44 NOZZLE FORMATION SECTION, 45 FRONT END, 46 REAR END, 51 TRANSPORT ROLLER, 53 MOTOR, 55 TIMING BELT, 61 CASE, 63 SHEET MEMBER, 64 BONDING SECTION, 65 CONTAINING SECTION, 67 COMMUNICATION SECTION, 68 AIR CHAMBER, 73 COMMUNICATION PATH, 80 BASE WALL, 81 FIRST WALL, 82 SECOND WALL, 82A INNER WALL, 83 THIRD WALL, 84 FOURTH WALL, 85 FIFTH WALL, 86 SIXTH WALL, 87 SEVENTH WALL, 91 RECESS SECTION, 99 RECESS SECTION, 101 INK INTRODUCTION SECTION, 105 OVERHANG SECTION, 105A, 105B, 105C, 105D PART, 108 GROOVE, 109 RECESS SECTION, 111 EIGHT WALL, 112 NINTH WALL, 113 TENTH WALL, 114 SUPPLY SECTION, 115 CONNECTION SECTION, 116 SUPPLY OPENING, 118 AIR COMMUNICATION OPENING, 121, 122 COMMUNICATION OPENING, 131 RECESS SECTION, 132 OPENING, 133 SIDE WALL, 141 INK, 143 CAP, 151 FIRST FLOW PATH, 152 SECOND FLOW PATH, 153 THIRD FLOW PATH, 154 FOURTH FLOW PATH, 155 FIFTH FLOW PATH, 156 SIXTH FLOW PATH, 161 REVERSE SECTION, 162 CURVE SECTION, 163 CURVE SECTION, 164 CURVE SECTION, 165 REVERSE SECTION, 166 CURVE SECTION, 171 LIQUID SURFACE, 173 FIRST GROUP, 174 SECOND GROUP, 175 HYPOTHETICAL REGION, P PRINTING MEDIUM

The invention claimed is:

1. A liquid ejecting apparatus comprising:

a front surface facing front when the liquid ejecting apparatus is in a used state and a rear surface facing opposite to the front surface;

a nozzle formation section where nozzles are formed, the liquid ejecting apparatus performing printing onto a printing medium using the liquid by ejecting the liquid from the nozzles toward the printing medium in the used state in which the nozzles are aligned along a horizontal direction and face downward, the nozzle formation section including a front end which is positioned closest to the front surface and a rear end which is positioned farthest from the front surface:

a discharge opening provided on the front surface of the liquid ejecting apparatus, the printing medium onto which printing is performed being discharged via the discharge opening: and a liquid container disposed so that a liquid surface of the liquid which is contained in the liquid container is lower than the rear end of the nozzle formation section when the liquid ejecting apparatus is in a first posture, the first posture being a non-usage posture where the rear surface is placed on a horizontal flat surface and the front end of the nozzle formation section is positioned above the rear end;

wherein the liquid container has a liquid supply opening for supplying the liquid which is contained in the liquid container to the liquid ejecting apparatus, and the liquid container is disposed so that the liquid surface is higher than the rear end of the nozzle formation section and the liquid supply opening is higher than the liquid surface when the liquid ejecting apparatus is in a second posture, the second posture being a non-usage posture where the front surface is placed on the horizontal flat surface and the front end of the nozzle formation section is positioned below the rear end.

* * * * *